US009653791B2

(12) United States Patent
Yamagajo

(10) Patent No.: US 9,653,791 B2
(45) Date of Patent: May 16, 2017

(54) ANTENNA DEVICE AND COMMUNICATION DEVICE

(71) Applicant: FUJITSU LIMITED, Kawasaki-shi, Kanagawa (JP)

(72) Inventor: Takashi Yamagajo, Yokosuka (JP)

(73) Assignee: FUJITSU LIMITED, Kawasaki (JP)

( * ) Notice: Subject to any disclaimer, the term of this patent is extended or adjusted under 35 U.S.C. 154(b) by 318 days.

(21) Appl. No.: 14/033,105

(22) Filed: Sep. 20, 2013

(65) Prior Publication Data

US 2014/0091978 A1 Apr. 3, 2014

(30) Foreign Application Priority Data

Sep. 28, 2012 (JP) ..... 2012-218520

(51) Int. Cl.
*H01Q 1/24* (2006.01)
*H01Q 1/50* (2006.01)
(Continued)

(52) U.S. Cl.
CPC ..... *H01Q 1/50* (2013.01); *H01Q 1/243* (2013.01); *H01Q 1/36* (2013.01); *H01Q 5/335* (2015.01);
(Continued)

(58) Field of Classification Search
CPC ..... H01Q 5/335; H01Q 5/378; H01Q 1/50; H01Q 9/40; H01Q 1/243; H01Q 9/42; H01Q 1/36
See application file for complete search history.

(56) References Cited

U.S. PATENT DOCUMENTS 4,083,046 A * 4/1978 Kaloi ..... H01Q 9/0407 343/700 MS
8,334,810 B2 * 12/2012 Foo ..... H01Q 1/42 343/700 MS
(Continued)

FOREIGN PATENT DOCUMENTS

JP 2005-210520 A 8/2005
JP 2005-252526 A 9/2005
(Continued)

OTHER PUBLICATIONS

Office Action of Japanese Patent Application No. 2012-218520 dated Feb. 9, 2016 with partial translation.

*Primary Examiner* — Graham Smith
*Assistant Examiner* — Noel Maldonado
(74) *Attorney, Agent, or Firm* — Arent Fox LLP

(57) ABSTRACT

An antenna device includes a substrate, a first antenna element disposed on a surface of the substrate, a second antenna element disposed on the surface of the substrate, the second antenna element being a linear shape, a length of the second antenna element being shorter than twice a length of a side that determines a lowest operating frequency of the first antenna element, a grounding conductor disposed so as not to overlap with the first antenna element and the second antenna element, a feeder coupled to the first antenna element, a first switch and a second switch disposed at the feeder wire, a first matching element and a second matching element disposed between the feeder wire and the grounding conductor, respectively, a third switch configured to switch connecting states of the first antenna element and the second antenna element.

24 Claims, 27 Drawing Sheets

(51) Int. Cl.

| | |
|---|---|
| ***H01Q 1/36*** | (2006.01) |
| ***H01Q 9/40*** | (2006.01) |
| ***H01Q 9/42*** | (2006.01) |
| ***H01Q 5/335*** | (2015.01) |
| ***H01Q 5/378*** | (2015.01) |

(52) U.S. Cl.
CPC ..... *H01Q 5/378* (2015.01); *H01Q 9/40* (2013.01); *H01Q 9/42* (2013.01)

(56) References Cited

U.S. PATENT DOCUMENTS

| | | | | |
|---|---|---|---|---|
| 2005/0162328 | A1 | 7/2005 | Mori | |
| 2006/0050007 | A1 | 3/2006 | Min | |
| 2011/0159832 | A1 | 6/2011 | Yamagajo et al. | |
| 2012/0127055 | A1 | 5/2012 | Yamagajo | |
| 2014/0015729 | A1* | 1/2014 | Uejima ..... | H01Q 9/14 343/850 |

FOREIGN PATENT DOCUMENTS

| | | | |
|---|---|---|---|
| JP | 2006-81181 | A | 3/2006 |
| JP | 2009-076961 | A | 4/2009 |
| JP | 2010-050548 | A | 3/2010 |
| JP | 2011-155626 | A | 8/2011 |
| JP | 2012-109875 | A | 6/2012 |

* cited by examiner

FIG. 6

| | FIRST OPERATION MODE | SECOND OPERATION MODE | THIRD OPERATION MODE | FOURTH OPERATION MODE |
|---|---|---|---|---|
| FIRST SWITCH | OFF | ON | OFF | OFF |
| SECOND SWITCH | OFF | OFF | OFF | ON |
| THIRD SWITCH | OFF | OFF | ON | ON |

| | FIFTH OPERATION MODE | SIXTH OPERATION MODE | SEVENTH OPERATION MODE | EIGHTH OPERATION MODE |
|---|---|---|---|---|
| FIRST SWITCH | OFF | OFF | ON | OFF |
| SECOND SWITCH | OFF | OFF | OFF | ON |
| THIRD SWITCH | OFF | ON | ON | ON |

| FREQUENCY BAND (GHz) | OPERATION MODE | FIRST SWITCH | SECOND SWITCH | THIRD SWITCH |
|---|---|---|---|---|
| 0.7 TO 0.9 | 4 | OFF | ON | ON |
| 0.9 TO 1.5 | 3 | OFF | OFF | ON |
| 1.5 TO 1.8 | 2 | ON | OFF | OFF |
| 1.8 TO 6 | 1 | OFF | OFF | OFF |

ANTENNA DEVICE AND COMMUNICATION DEVICE

CROSS-REFERENCE TO RELATED APPLICATION

This application is based upon and claims the benefit of priority of the prior Japanese Patent Application No. 2012-218520, filed on Sep. 28, 2012, the entire contents of which are incorporated herein by reference.

FIELD

The embodiments discussed herein are related to an antenna device and a communication device.

BACKGROUND

With the recent rapid growth of wireless communication industry, it is desirable to provide a mobile terminal device that supports various wireless communication services based on various wireless communication standards. Types of wireless communication services include Long Term Evolution (LTE) standardized by the 3rd Generation Partnership Project (3GPP), Wireless Fidelity (WiFi) on the IEEE802.11 standard, Bluetooth on the IEEE802.15.1 standard, the Worldwide Interoperability for Microwave Access (WiMAX) on the IEEE802.16e standard, and the Global Positioning System (GPS) having a usage frequency band of 1.563 to 1.578 GHz.

The frequency band used for wireless signals transmitted and received between the mobile terminal device and other devices, such as a base station device, differs depending on the type of wireless communication service used. It is thus desirable to provide an antenna that may transmit and receive wireless signals over a wide frequency band in the mobile terminal device such that the mobile terminal device may support the many different types of wireless communication services.

Recently, mobile terminal devices have been reduced in size and in thickness. In order to further reduce the size and thickness of the mobile terminal device, it is desirable to also reduce the size and thickness of the antenna provided in the mobile terminal device.

As a related technology, a proposed antenna device includes a substrate, a radiation electrode, a grounding electrode, an impedance matching element, and a switch. The radiation electrode is provided on a substrate and is configured to transmit and receive wireless signals in a wider bandwidth. The grounding electrode is provided on a back surface of the substrate. A feeder wire is connected to the radiation electrode via a feeding point and is provided on the substrate. The impedance matching element is provided at a position of a predetermined distance from the feeding point. One end of the impedance matching element is connected with the grounding electrode arranged on the back surface, and the other end thereof is provided to be connected with the feeder wire via a switch in parallel with the radiation electrode. When the switch is operated in accordance with a predetermined control signal and the impedance matching element and the feeder wire are connected, impedance of the radiation electrode is matched by the impedance matching element with respect to a signal having a predetermined frequency.

As another related technology, a proposed antenna device includes a main antenna, an antenna adjusting unit, and a switching unit. The antenna adjusting unit is connected to one side of the main antenna having a fixed length. The antenna adjusting unit connects one or more sub antennas to the main antenna in accordance with transmission and reception quality (or change in the peripheral environment) of a terminal to change the length of the main antenna. The switching unit causes the switch to operate in accordance with the operating frequency band of the terminal and connects the main antenna or another antenna corresponding to a predetermined frequency band to a matching circuit.

As yet another related technology, a proposed antenna device includes a grounding conductor, a first antenna element, a second antenna element, and a feeding point. The first antenna element is an inverse L-shaped antenna constituted by a relatively short first side and a relatively long second side, and which operates with a resonance frequency of a fundamental mode and a higher mode. The feeding point is provided between the grounding conductor and the first side of the first antenna element. The second antenna element is an antenna of which one end is combined to the first side of the first antenna element. The second antenna element forms an inverse L-shape between the first antenna element and the feeding point. The second antenna element includes a first switch that may selectively change the antenna length of the second antenna element and a second switch that may selectively connect the feeding point and the second antenna element. The antenna device operates in different frequency bands in accordance with opening and closing of the first and the second switches.

Japanese Laid-open Patent Publication No. 2011-155626, Japanese Laid-open Patent Publication No. 2006-81181, and Japanese Laid-open Patent Publication No. 2009-76961 contain information further to the related art technology discussed above.

SUMMARY

According to an aspect of the invention, an antenna device includes a substrate, a first antenna element disposed on a surface of the substrate, the first antenna element having predetermined antenna characteristics over a certain band, a second antenna element disposed on the surface of the substrate, the second antenna element being a linear shape, a length of the second antenna element being shorter than twice a length of a side that determines a lowest operating frequency of the first antenna element, a grounding conductor disposed at a predetermined depth from the surface of the substrate so as not to overlap with the first antenna element and the second antenna element, a feeder wire disposed on the surface of the substrate, the feeder wire being coupled to a feeding point provided in the first antenna element, a first switch and a second switch disposed at the feeder wire at predetermined distances from the feeding point, a first matching element disposed between the feeder wire and the grounding conductor, the first matching element being coupled to the feeder wire in parallel when the first switch is turned to a conductive state, a second matching element disposed between the feeder wire and the grounding conductor, the second matching element being coupled to the feeder wire in parallel when the second switch is turned to a conductive state, and a third switch configured to switch connecting states of the first antenna element and the second antenna element.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 6 is an explanatory view of an operation mode of the antenna device according to the first embodiment;

DESCRIPTION OF EMBODIMENTS

Hereinafter, embodiments will be described in detail with reference to the drawings.

First Embodiment

Figure 1:
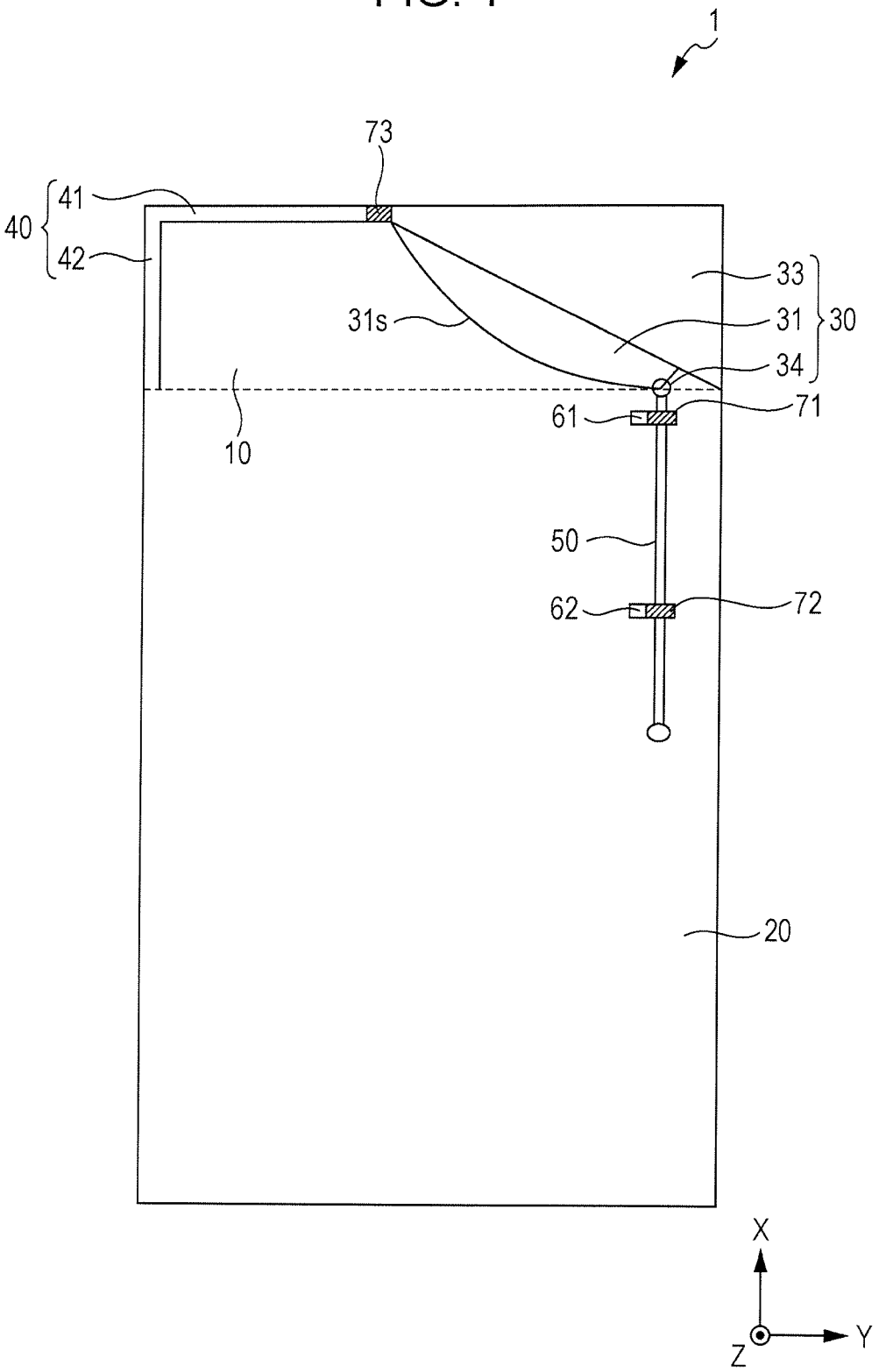
FIG. 1 is a schematic top view of an antenna device according to a first embodiment.
Figure 2:
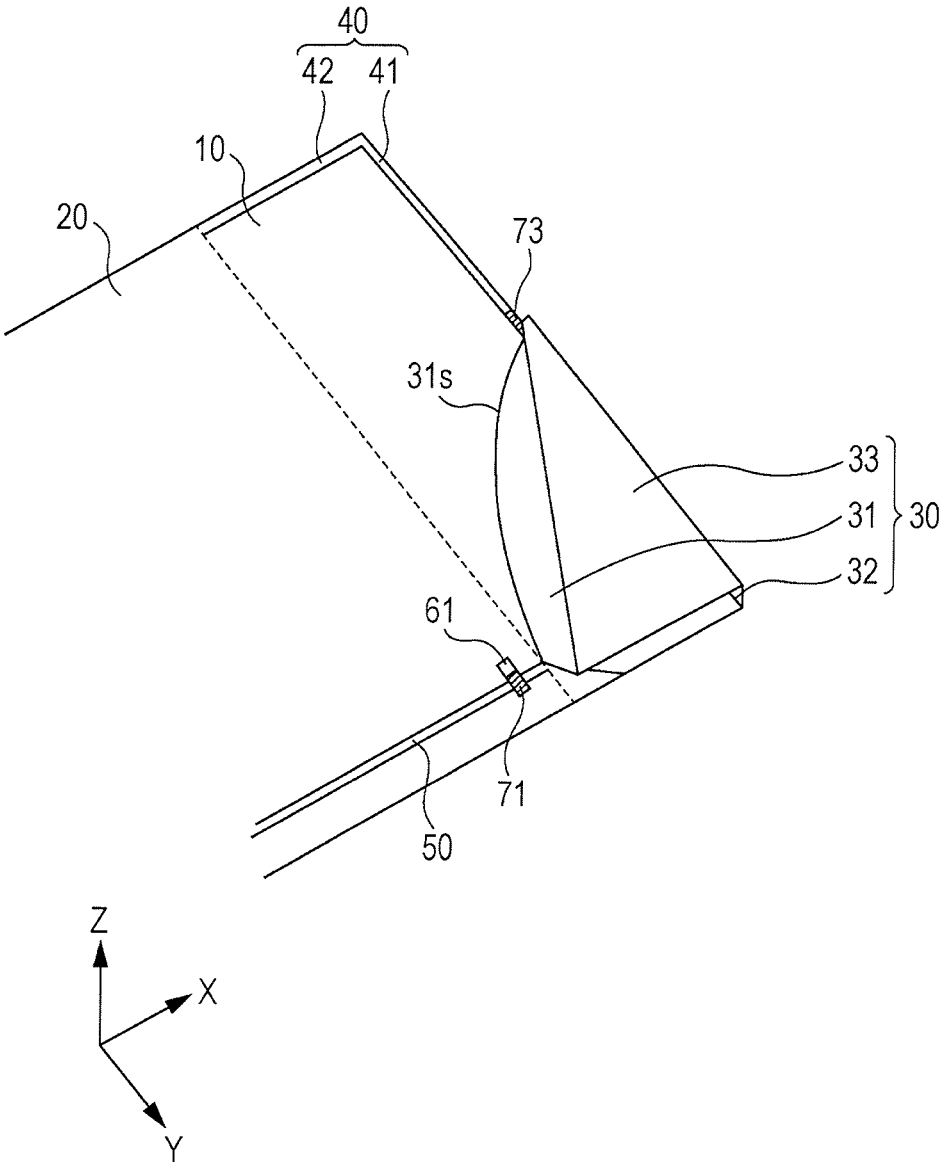
FIG. 2 is a schematic partial perspective view of the antenna device according to the first embodiment.
Figure 3:
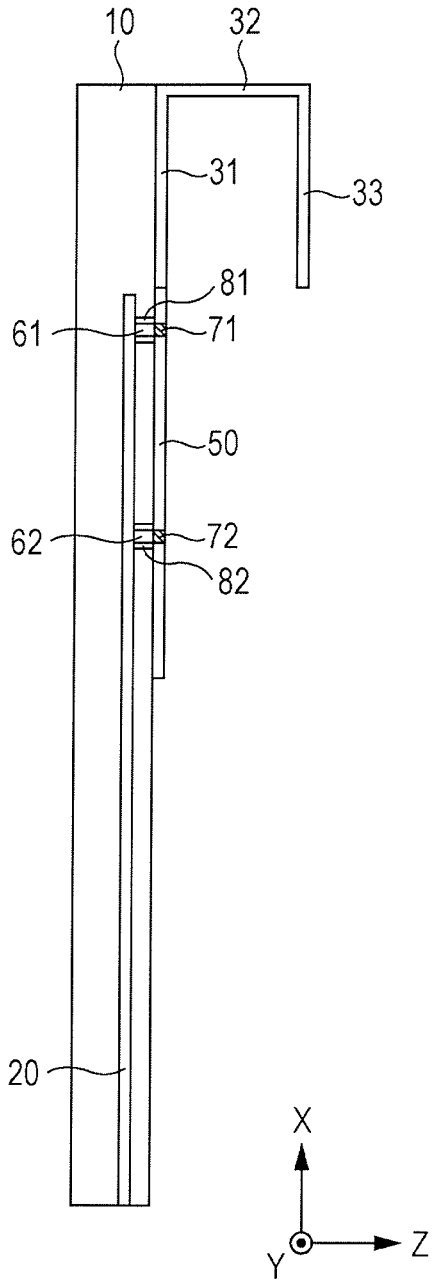
FIG. 3 is a schematic side view of the antenna device according to the first embodiment.

FIG. 1 is a schematic top view of an antenna device according to a first embodiment. FIG. 2 is a schematic partial perspective view of the antenna device according to the first embodiment. FIG. 3 is a schematic side view of the antenna device according to the first embodiment.

As illustrated in FIGS. 1 to 3, an antenna device according to the first embodiment may include a substrate 10, a grounding conductor 20, a first antenna element 30, a second antenna element 40, a feeder wire 50, a first matching element 61, a second matching element 62, a first switch 71, a second switch 72, and a third switch 73.

In the following description, unless otherwise stated, the term "height" refers to the length in the vertical direction in FIG. 1 (i.e., an X-axis direction of FIG. 1), the term "width" refers to the length in the horizontal direction in FIG. 1 (i.e., a y-axis direction) and the term "thickness" refers to the length in an upper direction in FIG. 1 (i.e., a Z-axis direction).

The substrate 10 may include a dielectric material or a magnetic material. For example, the substrate 10 may be composed of glass epoxy, ceramic or ferrite. The substrate 10 may be a thin board that includes a rectangular surface. The substrate 10 may be smaller in thickness than in height and in width thereof. The substrate 10 may be greater in height than in width so as to ensure an increased surface area of a grounding conductor 20.

The grounding conductor 20 may be a thin board including a rectangular surface. The grounding conductor 20 may include a conductive material, such as copper and/or gold.

As illustrated in FIG. 3, the grounding conductor 20 may be formed inside the substrate 10. An upper surface and a lower surface of the grounding conductor 20 and an upper surface and a lower surface of the substrate 10 may be parallel with one another. As illustrated in FIGS. 1 and 2, the grounding conductor 20 may not be formed below the first antenna element 30 and the second antenna element 40, which are formed on the surface of the substrate 10. The width of the grounding conductor 20 may be substantially the same as the width of the substrate 10, and the height of the grounding conductor 20 may be smaller than the height of the substrate 10. The grounding conductor 20 may form a microstrip line together with the feeder wire 50.

The first antenna element 30 may include a conductive material, such as copper and/or gold. The first antenna element 30 may be a wideband antenna having an electric length at the lowest operating frequency that is substantially equal to a ¼ wavelength. As illustrated in FIG. 1, the first antenna element 30 may be formed on the surface of the substrate 10. The first antenna element 30 may be formed so as not to protrude outside the surface of the substrate 10.

As illustrated in FIGS. 1 to 3, the first antenna element 30 may include a fan-shaped portion 31, a bent portion 32, and a triangular portion 33.

The fan-shaped portion 31 may include a substantially fan-like shape including a curved side 31*s*, and may be formed in contact with the surface of the substrate 10. The fan-shaped portion 31 may be formed so as not to protrude outside the surface of the substrate 10.

As will be describe later with reference to FIG. 4, the bent portion 32 and the triangular portion 33 are portions protruding outside the surface of the substrate 10 when the first antenna element 30 is aligned to a flat plane. In this embodiment, the first antenna element 30 may be bent so as not to protrude outside the surface of the substrate 10. By bending the first antenna element 30 in this manner, the height of the first antenna element 30, and thus the height of the antenna device 1, may be reduced while maintaining the surface area of the first antenna element 30.

The bent portion 32 is a portion of the first antenna element 30 that is in contact with the fan-shaped portion 31 and where the first antenna element 30 is bent vertically upward (in the Z-axis direction) from the surface of the substrate 10. The length of the bent portion 32 in the vertical direction may be predetermined in accordance with a thickness requested for the antenna device 1. It may be preferable to provide the triangular portion 33 on a side opposite to the side illustrated in FIG. 3 to reduce the size in the direction Z.

The triangular portion 33 is a portion of the first antenna element 30 that is in contact with the bent portion 32 and is further bent at the bent portion 32 vertically toward the substrate 10. A side of the triangular portion 33, which is in contact with the bent portion 32, corresponds to a side of the bent portion 32 in the width direction. As illustrated in FIG. 3, a surface of the triangular portion 33 is parallel with a surface of the fan-shaped portion 31.

As illustrated in FIG. 1, when the antenna device 1 is seen from above, a feeding point 34 is formed in the fan-shaped portion 31 at a position close to the grounding conductor 20 formed inside the substrate 10. The first antenna element 30 may be coupled to a feeder wire 50 via the feeding point 34. The first antenna element 30 may emit, in the air, a signal input from the feeder wire 50 as a wireless signal. The first antenna element 30 may output a received wireless signal to the feeder wire 50.

Figure 4:
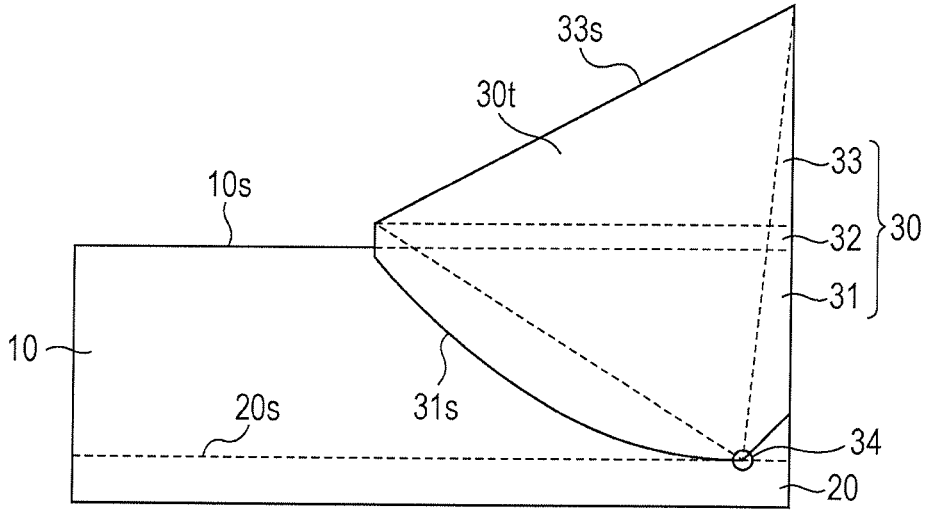
FIG. 4 is a developed view of the first antenna element according to the first embodiment.

FIG. 4 is a developed view of the first antenna element according to the first embodiment.

As illustrated in FIG. 4, when the fan-shaped portion 31, the bent portion 32, and the triangular portion 33 are aligned to the same flat plane, the first antenna element 30 becomes a projecting-shape with a base being a side 33*s* of the triangular portion 33 and a vertex being the feeding point 34. In the first embodiment, since the first antenna element 30 is formed in such a projecting surface shape, the first antenna element 30 is configured to include desirable antenna characteristics in a wider frequency band.

In the projecting-shaped first antenna element 30, the length along an outer edge of the first antenna element 30 from one end of the side 33*s*, which is the base to the feeding point 34 that is the vertex, may determine the lowest operating frequency of the first antenna element 30.

As illustrated in FIG. 4, the side 33*s* may not be parallel with a side 10*s* of the substrate 10 in the width direction and a side 20*s* of the grounding conductor 20 in the width direction, and the projecting-shaped first antenna element 30 may be formed toward the substrate 10. For example, when the feeding point 34, which is the vertex, and both ends of the side 33*s*, which is the base, are coupled connected by straight lines, a triangle 30*t* may be formed. A side 33*s*, which is a base of the triangle 30*t*, may not be parallel with the side 10*s* and the side 20*s* and, therefore, the triangle 30*t* may be tilted toward the substrate 10.

Since the projecting-shaped first antenna element 30 may be tilted toward the substrate 10 as illustrated in FIG. 4, the first embodiment may have the following advantageous effects.

First, since the first antenna element 30 is tilted, desirable antenna characteristics may be obtained over a wider band without reducing the size of the first antenna element 30, which includes the fan-shaped portion 31, the bent portion 32, and the triangular portion 33.

If the first antenna element 30 is not tilted, preventing the reduction of the size of the first antenna element 30, then the desirable antenna characteristics may not be obtained over a wider band. For example, an arrangement of the triangle 30*t* may be changed while keeping the shape and size of the triangle 30*t* so that the side 33*s* is parallel with the side 10*s* and the side 20*s*. Consequently, an area of a portion of the triangle 30*t* protruding in the height direction of the substrate 10 after the change of the arrangement becomes greater than an area protruding when the triangle 30*t* is tilted as illustrated in FIG. 4. If the protruding portion of the triangle 30*t* after the change of the arrangement is bent to be contained above the substrate 10, in the same manner as the bent portion 32 and the triangular portion 33 as illustrated in FIGS. 1 to 3, a part of the bent portion may be situated above the grounding conductor 20. Therefore, capacitive coupling may result between the portion situated above the grounding conductor 20 and the grounding conductor 20, whereby the antenna characteristics deteriorate. Then, when an attempt is made to bend such that the protruding portion of the triangle 30*t* after the change of the arrangement is not situated above the grounding conductor 20, it is desired that the length of bent portion 32 in the vertical direction (i.e., the Z-axis direction) is increased as illustrated in FIG. 3. If the length of bent portion 32 in the vertical direction is increased, the thickness of the entire antenna device 1 is also increased, whereby reduction in thickness of the antenna device 1 is not achieved. Therefore, it is desired that the shape and size of the triangle 30*t* are reduced in order for the portion of the bent triangle 30*t* not to be situated above the grounding conductor 20 and to reduce the length of the triangle 30*t* in the vertical direction. If the shape and size of the triangle 30*t* is reduced, the frequency band of the first antenna element 30 with desirable antenna characteristics becomes narrow.

Next, since the projecting-shaped first antenna element 30 is tilted, when the first antenna element 30 is bent as illustrated in FIGS. 1 to 3, the side 33*s* is tilted not in parallel with the side 20*s*, whereby an area in which the triangular portion 33 approaches the grounding conductor 20 may be made small. If the area in which the triangular portion 33 approaches the grounding conductor 20 may be made small, capacitive coupling between the triangular portion 33 and the grounding conductor 20 may be reduced, whereby the first antenna element 30 may obtain desirable antenna characteristics.

If, on the other hand, the first antenna element 30 is not tilted, then the side 33*s*, which is the base of the projecting portion, remains parallel with the side 20*s*, and an area in which the first antenna element 30 approaches the grounding conductor 20 among the bent portion above the substrate 10 becomes large. Consequently, capacitive coupling is produced between the bent portion of the first antenna element 30 and the grounding conductor 20, deteriorating the antenna characteristics.

As illustrated in FIG. 4, the fan-shaped portion 31 includes a curved side 31*s* on the side on which the first antenna element 30 is tilted toward the substrate 10. The side 31*s* curves outside toward the grounding conductor 20 as compared with a straight line, which connects one end of the side 33*s* with the feeding point 34. By forming the side 31*s* in this manner, the distance between the fan-shaped portion 31 and the grounding conductor 20 may be changed gradually, and the change in impedance produced due to capacitive coupling between the grounding conductor 20 and the fan-shaped portion 31 may be made gradually. Thus, impedance matching of an antenna may be easily performed and, therefore, antenna characteristics may be improved.

The second antenna element 40 may be made of a conductive material, such as copper and/or gold. As illustrated in FIG. 1, the second antenna element 40 may be formed on the same surface of the substrate 10 as the first antenna element 30, and may be formed in contact with the surface of the substrate 10. The second antenna element 40 may be formed so as not to protrude outside the surface of the substrate 10.

As illustrated in FIGS. 1 and 2, the second antenna element 40 includes a first straight portion 41 and a second straight portion 42.

The first straight portion 41 may be linear in shape, and one end of the first straight portion 41 may be coupled to the fan-shaped portion 31 via the third switch 73. When the third switch 73 is turned ON and the first straight portion 41 is coupled to the fan-shaped portion 31, the antenna constituted by the first antenna element 30 and the second antenna element 40 functions as a monopole antenna having an electric length at the lowest operating frequency, substantially equal to a ¼ wavelength.

As illustrated in FIGS. 1 to 3, a connecting position of the first straight portion 41 and the fan-shaped portion 31 is preferably distant from the feeding point 34 provided in the first antenna element 30. For example, as illustrated in FIG. 1, the first straight portion 41 may extend in a direction away from the first antenna element 30 along the side of the substrate 10 in the width direction.

As illustrated in FIG. 1, the second straight portion 42 is a portion of the second antenna element 40 bent vertically from the linearly extending first straight portion 41 so that the second antenna element 40 is situated above the surface of the substrate 10. As illustrated in FIG. 1, the grounding conductor 20 may not exist below an end portion of the second straight portion 42 that is not in contact with the first straight portion 41.

The feeder wire 50 may be formed on the surface of the substrate 10, which is the same as those of the first antenna element 30 and the second antenna element 40, and one end of the feeder wire 50 may be coupled to the feeding point 34 of the first antenna element 30. A transmission and reception module 90 (see FIG. 5) may be coupled to the other end of the feeder wire 50, which is not connected the feeding point 34. The feeder wire 50 may transmit a signal transmitted from the transmission and reception module 90 to the first antenna element 30, and transmit the signal received from the first antenna element 30 to the transmission and reception module 90. The feeder wire 50 may be formed as a distributed constant line, and may form a microstrip line together with the grounding conductor 20 formed inside the substrate 10.

The first matching element 61 and the second matching element 62 are elements with inductance and are, for example, inductors.

One end of the first matching element 61 may be coupled to the first switch 71 and the other end of the first matching element 61 may be coupled to the grounding conductor 20 with a via 81. One end of the second matching element 62 may be coupled to the second switch 72 and the other end of the second matching element 62 may be coupled to the grounding conductor 20 with a via 82. As will be described later, the first matching element 61 and the second matching element 62 may be disposed at positions of predetermined distances from the feeding point 34. The first matching element 61 may be disposed at a position closer to the feeding point 34 than the second matching element 62.

The first matching element 61 and the second matching element 62 may be short stubs. The first switch 71 connects or disconnects the first matching element 61 to or from the feeder wire 50 in accordance with the control signal from a control circuit (not illustrated). The first switch 71 may be disposed such that a distance (i.e., the length) of the feeder wire 50 from the feeding point 34 to the first switch 71 is a predetermined distance.

The second switch 72 connects or disconnects the second matching element 62 to or from the feeder wire 50 in accordance with a control signal from the control circuit. The second switch 72 may be disposed such that a distance (i.e., the length) of the feeder wire 50 from the feeding point 34 to the second switch 72 is a predetermined distance.

The third switch 73 connects or disconnects the second antenna element 40 to or from the first antenna element 30 in accordance with a control signal from the control circuit.

Examples of the first switch 71, the second switch 72, and the third switch 73 include mechanical relay-type switches, such as a microelectromechanical systems (MEMS) switch, and solid-state switches, such as a PIN diode switch and a GaAs switch.

Two matching elements 61 and 62 and two switches 71 and 72 corresponding to the two matching elements 61 and 62 may be formed in the antenna device 1 illustrated in FIG. 1. However, the number of matching elements provided in the antenna device 1 according to the embodiment is not limited to two: the matching elements may be three or more in accordance with the size of an operating frequency band requested to the antenna device 1. Further, the number of switches with which the matching element and the feeder wire are connected or disconnected may be increased corresponding to the number of provided matching elements.

Figure 5:
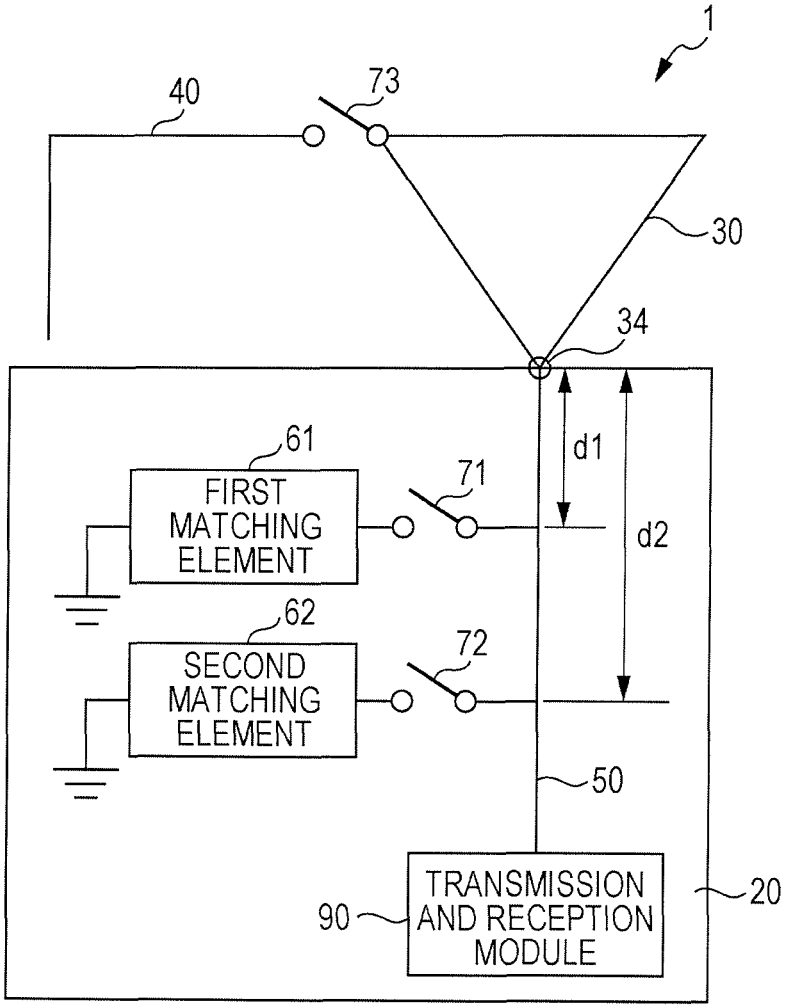
FIG. 5 is a circuit diagram of the antenna device according to the first embodiment.

FIG. 5 is a circuit diagram of the antenna device according to the first embodiment.

Each component in the circuit diagram illustrated in FIG. 5 is denoted by the same reference numeral as that of each component of the antenna device 1 illustrated in FIG. 1. The transmission and reception module 90 is illustrated in FIG. 5. The transmission and reception module 90 is a signal source of predetermined frequency and may be coupled to the other end of the feeder wire 50 which is different from the one end of the feeder wire 50 that is coupled to the feeding point 34.

As illustrated in FIG. 5, the first matching element 61 is coupled, via the first switch 71, in parallel with the microstrip line formed by the feeder wire 50 and the grounding conductor 20. When the first switch 71 disposed at a predetermined distance from the feeding point 34 is turned ON, the first matching element 61 is coupled to the feeder wire 50.

The second matching element 62 is coupled, via the second switch 72, in parallel with the microstrip line formed by the feeder wire 50 and the grounding conductor 20. When the second switch 72 disposed at a predetermined distance from the feeding point 34 is turned ON, the second matching element 62 is coupled to the feeder wire 50.

Antenna impedance of the antenna device 1, which is constituted, for example, by the first antenna element 30, is preferably designed to be, for example, 50Ω, which is the same as those of external circuits, such as a signal source, so that impedance matching is performed over the entire frequency band used in the antenna device 1. For this purpose, the larger the antenna included in the antenna device 1, the better. However, the size of the antenna is restricted by, for example, the size of a communication device on which the antenna device 1 is mounted. In a case in which the antenna size is not sufficient, for example, conductance of the antenna becomes smaller than 20 mS in a low frequency band in a usage frequency band of the antenna device 1.

In the antenna device 1 according to the first embodiment, when a wireless signal in such a low frequency band described above is transmitted and received, the first switch 71 or the second switch 72 disposed at a predetermined distance from the feeding point 34 is turned ON.

As described above, the feeder wire 50 may be formed as a distributed constant line. Then, when the first switch 71 or the second switch 72 is turned ON, a phase of impedance of the antenna rotates in accordance with a distance d1 from the feeding point 34 to the first switch 71 or a distance d2 from the feeding point 34 to the second antenna switch.

As described above, the first matching element 61 or the second matching element 62 includes inductance. Then, when the first switch 71 or the second switch 72 is turned ON, capacitive susceptance of admittance of the antenna is compensated for in accordance with an inductance value of the first matching element 61 or the second matching element 62.

In this manner, by turning the first switch 71 or the second switch 72 disposed from the feeding point 34 at the predetermined distance ON, the antenna impedance of the antenna device 1 may be matched with impedance (for example, 50Ω) of external circuits. Therefore, the antenna characteristics of the antenna device 1 in a low frequency band in a usage frequency band of the antenna device 1 may be improved.

Inductance $L_{ind}$ of the first matching element 61 or the second matching element 62 and the length l of the feeder wire 50 from the feeding point 34 to a point at which the first switch 71 or the second switch 72 is connected are determined in the following manner.

First, impedance $Z_L$ of the antenna at frequency $f_0$ is expressed by the following Equation (1). Here, the term "antenna" refers to an antenna constituted by the first antenna element 30 when the third switch 73 is OFF. The term "antenna" refers to an antenna constituted by the first antenna element 30 and the second antenna element 40 when the third switch 73 is ON.

$$Z_L = R_{f0} + jX_{f0} \tag{1}$$

$Rf_0$ in Equation (1) is resistance at frequency $f_0$ and $X_{f0}$ is reactance at frequency $f_0$.

The length of the feeder wire 50 from the feeding point 34 to the position at which the first switch 71 or the second switch 72 is disposed is set to l.

The length l for letting conductance G of the total of the antenna and the feeder wire 50 of length l coincide with admittance (for example, 20 mS) corresponding to impedance of external circuits (for example, 50Ω) is expressed by the following Equation (2). Conductance G is a real part (for example, 50Ω) of admittance Y of the total of the antenna and the feeder wire 50 of length l.

$$l = \frac{1}{\beta}\tan^{-1}\left[\frac{-X_{f0}Z_0 \pm \sqrt{(X_{f0}Z_0)^2 - (Z_0^2 - R_{f0}Z_0)(X_{f0}^2 + R_{f0}^2 - Z_0R_{f0})}}{Z_0^2 - R_{f0}Z_0}\right] \tag{2}$$

$Z_0$ in Equation (2) is characteristic impedance $Z_0$ of the feeder wire 50 and is, for example, 50Ω. β is a phase constant and is expressed by the following Equation (3).

$$\beta = \frac{2\pi}{\lambda_{eff}} \tag{3}$$

$\lambda_{eff}$ in Equation (3) is a wavelength of a signal corresponding to frequency $f_0$ in consideration of wavelength shortening by the material of the substrate 10.

Two solutions exist for the length l that satisfy Equation (2). Of these solutions, the shorter one may be selected.

Susceptance B of the total of the antenna and the feeder wire 50 of length l is expressed by the following Equation (4). Susceptance B is an imaginary part of admittance Y of the total of the antenna and the feeder wire 50 of length l and is a capacity component in the present embodiment.

$$B = -\frac{1}{Z_0}\frac{j(X_{f0}Z_0 + (Z_0^2 - R_{f0}^2 - X_{f0}^2)\tan\beta l - X_{f0}Z_0\tan^2\beta l)}{R_{f0}^2 + (X_{f0} + Z_0\tan\beta l)^2} \tag{4}$$

In the first embodiment, impedance of the antenna is matched when the first matching element 61 or the second matching element 62 with inductance $L_{ind}$, which compensates for susceptance B expressed by Equation (4), is connected in parallel with the feeder wire 50. Inductance $L_{ind}$ is expressed by the following Equation (5).

$$L_{ind} = \frac{1}{2\pi f_0 B} \tag{5}$$

In the first embodiment, the antenna characteristics of the antenna device 1 in the low frequency band are improved by configuring the antenna device 1 such that the first switch 71, the second switch 72, and the third switch 73 are switched in the following manner.

Figure 7:
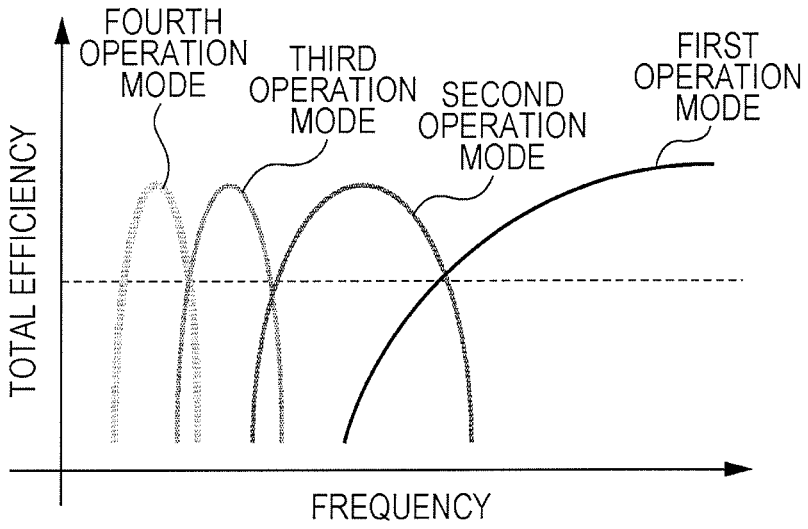
FIG. 7 is an explanatory view of a relationship between the operation mode illustrated in FIG. 6 and frequency characteristics of total efficiency.

FIG. 6 is an explanatory view of an operation mode of the antenna device according to the first embodiment. FIG. 7 is an explanatory view of a relationship between the operation mode illustrated in FIG. 6 and frequency characteristics of total efficiency.

In a first operation mode illustrated in FIG. 6, the first switch 71, the second switch 72 and the third switch 73 are controlled to be turned OFF in accordance with a control signal from a control circuit. Therefore, in the first operation mode, since the third switch 73 is OFF, only the first antenna element 30 is used as the antenna of the antenna device 1. Since the first switch 71 and the second switch 72 are OFF, matching of antenna impedance, for which the first matching element 61 and the second matching element 62 are used, is not performed.

As described above, the first antenna element 30 has a shape suitable for transmitting and receiving wideband wireless signals. Then, as illustrated in FIG. 7, total efficiency of the antenna of the antenna device 1 in the first operation mode is desirable over a wider band. Total efficiency is a ratio between total input power from a signal source and radiation power from the antenna. Let radiant efficiency of the antenna be denoted by $\eta$ and let the reflection coefficient be denoted by $S_{11}$, total efficiency $\eta_t$ is expressed by the following Equation (6).

$$\eta_t=\eta(1-|S_{11}|^2) \tag{6}$$

In a second operation mode illustrated in FIG. 6, the first switch 71 is controlled to be turned ON and the second switch 72 and the third switch 73 are controlled to be turned OFF in accordance with a control signal from the control circuit. Therefore, in the second operation mode, since the third switch 73 is OFF, only the first antenna element 30 is used as the antenna of the antenna device 1. Since the first switch 71 is ON, antenna impedance is matched by the feeder wire 50 of a distance d1 from the feeding point 34 to the first switch 71 and the first matching element 61.

As illustrated in FIG. 7, total efficiency of the antenna in the second operation mode is more desirable in a low frequency band than in the first operation mode since the first switch 71 is controlled to be turned ON to perform matching of antenna impedance. Therefore, in the second operation mode, the antenna device 1 is operable at a lower frequency band than in the first operation mode.

In a third operation mode illustrated in FIG. 6, the first switch 71 and the second switch 72 are controlled to be turned OFF and the third switch 73 is controlled to be turned ON in accordance with a control signal from the control circuit. Therefore, in the third operation mode, since the third switch 73 is ON, the first antenna element 30 and the second antenna element 40 are used as the antennas of the antenna device 1. The antenna of the antenna device 1 constituted by the first antenna element 30 and the second antenna element 40 is a monopole antenna. Since the first switch 71 and the second switch 72 are OFF, matching of antenna impedance for which the first matching element 61 and the second matching element 62 are used is not performed.

In the third operation mode, since the first antenna element 30 and the second antenna element 40 are connected, the antenna length is increased by the length of the first straight portion 41 and the second straight portion 42. Therefore, the antenna of the third operation mode may have an electric length desired in the low frequency band, as compared with the antenna in the first and the second operation modes. That is, in the third operation mode, since the first antenna element 30 and the second antenna element 40 are connected, volume of the antenna of the antenna device 1 may be increased. Therefore, in the third operation mode, radiant efficiency of the antenna in the low frequency band may be increased as compared with the first and the second operation modes. Then, as illustrated in FIG. 7, since the third switch 73 is controlled to be turned ON, total efficiency of the antenna in the third operation mode is desirable in the low frequency band as compared with the first and the second operation modes. Therefore, in the third operation mode, the antenna device 1 is operable at a lower frequency band than in the second operation mode.

In a fourth operation mode illustrated in FIG. 6, the first switch 71 is controlled to be turned OFF and the second switch 72 and the third switch 73 are controlled to be turned ON in accordance with a control signal from the control circuit. Therefore, in the fourth operation mode, since the third switch 73 is ON, the first antenna element 30 and the second antenna element 40 are used as the antennas of the antenna device 1. Since the second switch 72 is ON, antenna impedance is matched by the feeder wire 50 of the distance d2 from the feeding point 34 to the second switch 72 and the second matching element 62.

As illustrated in FIG. 7, total efficiency of the antenna in the fourth operation mode is more desirable than in the third operation mode in the low frequency band since the second switch 72 is controlled to be turned ON to perform matching of antenna impedance. Therefore, in the fourth operation mode, the antenna device 1 is operable at a lower frequency band than in the third operation mode.

Thus, the antenna device 1 according to the first embodiment uses the first antenna element 30 with desirable antenna characteristics in a wider band, as the antenna in the first operation mode. In addition, in the third operation mode, the antenna device 1 according to the first embodiment uses a monopole antenna, which is formed by connecting the first antenna element 30 and the second antenna element 40 to be usable in the low frequency band having a long electric length.

Therefore, in comparison with an antenna device which is constituted only by a wideband antenna, such as an ultra-wide band (UWB) antenna, which performs matching of antenna impedance by sequentially switching a plurality of switches disposed at predetermined distances from the feeding point, the antenna device 1 according to the first embodiment may include improved antenna characteristics in the low frequency band.

In the second operation mode, the antenna device 1 according to the first embodiment tries to perform matching of antenna impedance in the lower frequency band than in the first operation mode by the feeder wire 50 of the distance d1 and the first matching element 61 by turning the first switch 71 ON. In addition, in the fourth operation mode, the antenna device 1 according to the first embodiment tries to perform matching of antenna impedance in the low frequency band than in the third operation mode by the feeder wire 50 of the distance d2 and the second matching element 62 by turning the second switch 72 ON. That is, in the first embodiment, the maximum distance (length) of the feeder wire 50 adjusted to obtain desirable antenna characteristics in the predetermined frequency bandwidth is the distance d2 from the feeding point 34 to the second switch 72.

Figure 8:
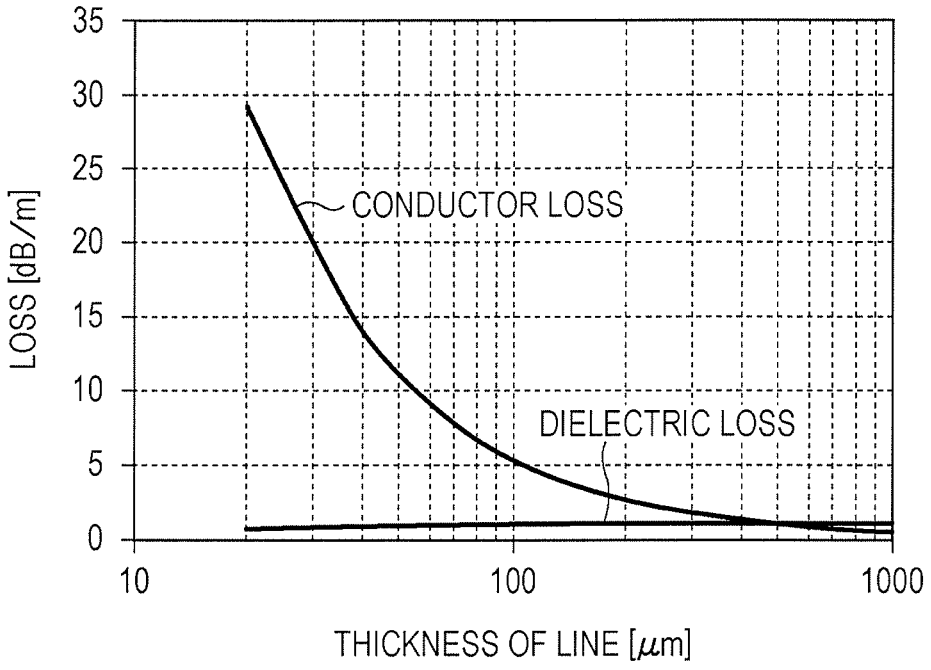
FIG. 8 is a relationship diagram between thickness of a line and loss.

FIG. 8 is a relationship diagram between thickness of a line and loss. Thickness of the line in FIG. 8 refers to a distance between the feeder wire 50 and the grounding conductor 20. As will be understood from FIG. 8, the smaller the thickness of the line, the greater the conductor loss becomes. For example, thickness of the line in a substrate for a recent personal digital assistant unit may be 50 micrometers or smaller, and conductor loss of the line may be 10 dB/m or greater. In a case in which the thickness of the line is thus small, if the distance of the line desirable for the matching from the feeding point to the switch becomes long, loss of the line becomes too large to ignore even if matching of antenna impedance is performed. In addition, in an antenna device constituted only by a wideband antenna, such as a UWB antenna, since radiation resistance is small in the low frequency band, antenna characteristics, such as radiant efficiency of the antenna and total efficiency, decrease significantly due to slight loss of the line.

The antenna device 1 according to the first embodiment includes the first antenna element 30, which is a wideband antenna, and also includes a linear second antenna element 40, and performs switching control among the first to fourth operation modes as described above. Therefore, the distance of the feeder wire 50 from the feeding point 34 to the first switch 71 or the second switch 72 may be shortened. Therefore, according to the first embodiment, even if the thickness of the line is small, an increase in loss of the line may be reduced, and a decrease in radiant efficiency of the antenna and in total efficiency may be reduced.

The first antenna device 1, which includes the first antenna element 30 and the second antenna element 40 and performs switching control among the first to the fourth operation modes, provides desirable antenna characteristics and will be described with reference to a specific simulation result. In order to compare with the antenna characteristics of the antenna device 1, a simulation result of an antenna device 2, which only includes the first antenna element 30 and sequentially switches a plurality of switches disposed at predetermined distances from the feeding point to perform matching of antenna impedance, will also be described.

Figure 9:
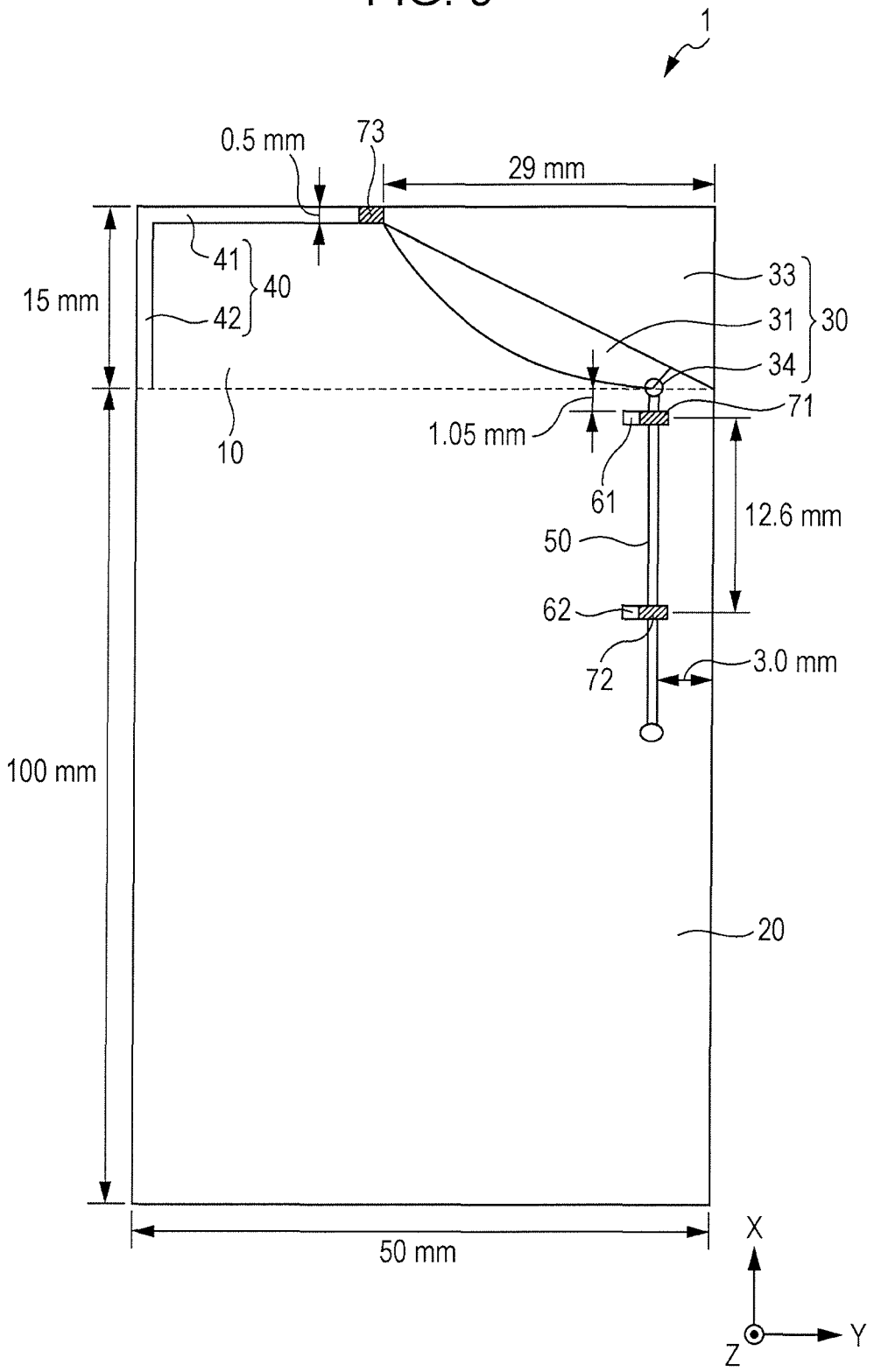
FIG. 9 is a first explanatory view of dimensions of each part of the antenna device of the first embodiment for which a simulation has been carried out.
Figure 10:
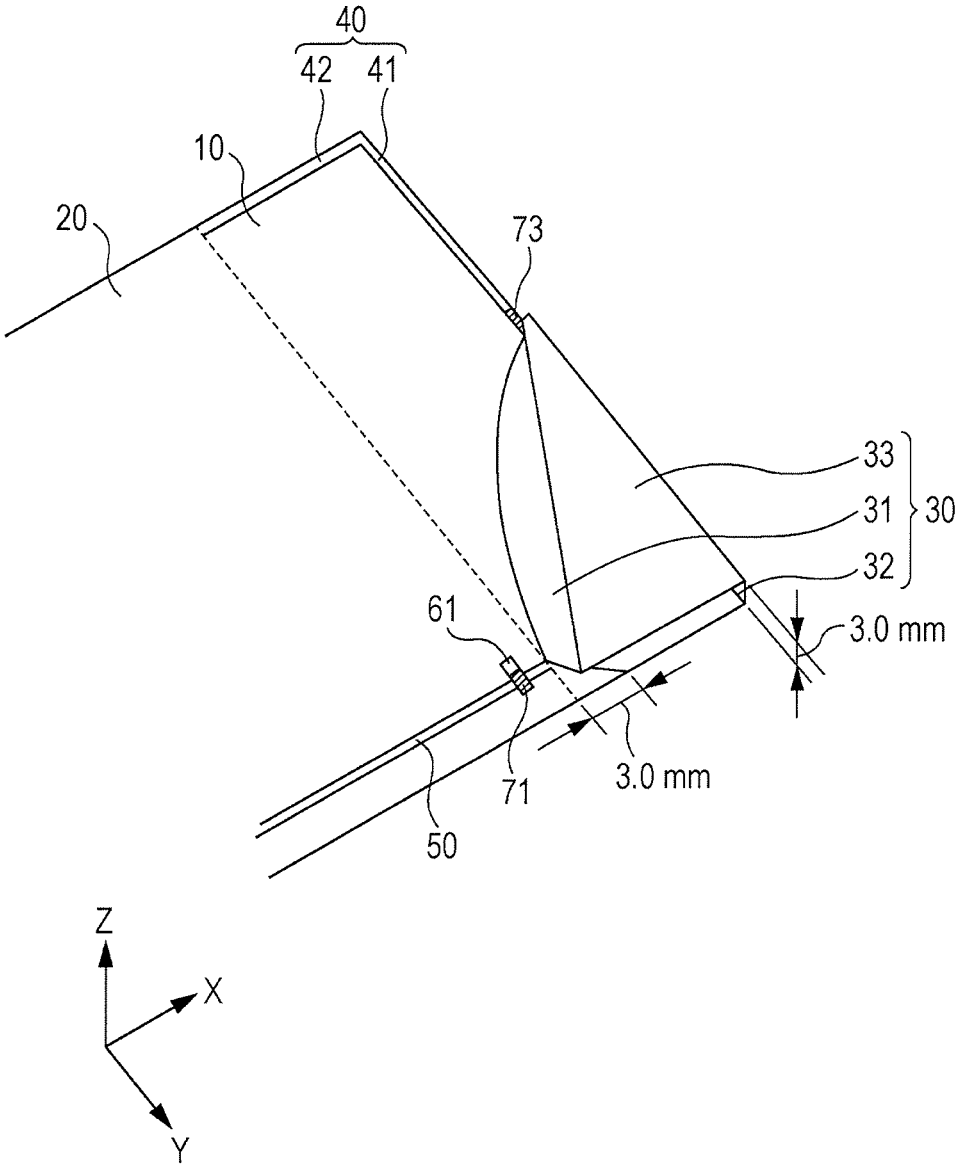
FIG. 10 is a second explanatory view of dimensions of each part of the antenna device of the first embodiment for which a simulation has been carried out.
Figure 11:
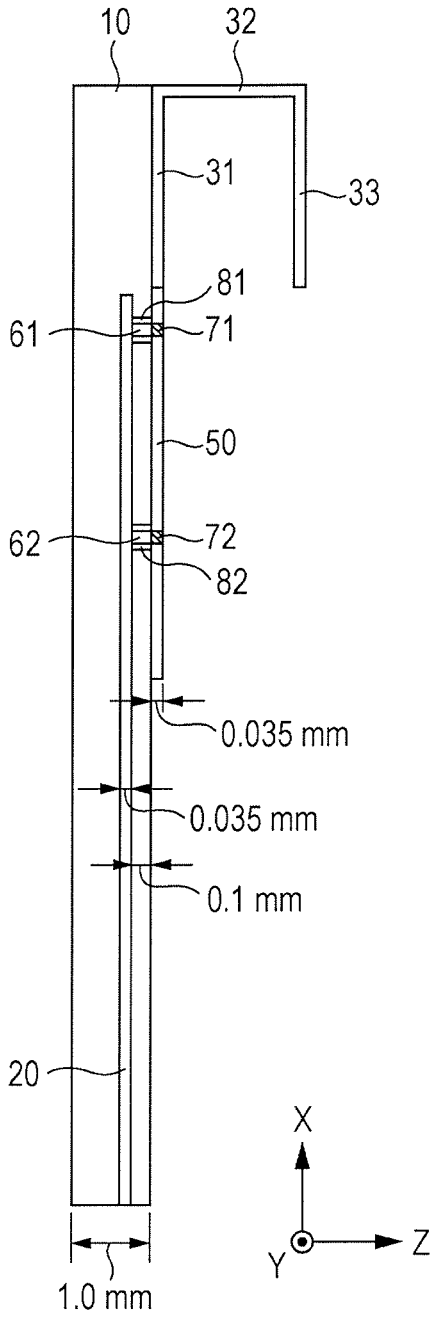
FIG. 11 is a third explanatory view of dimensions of each part of the antenna device of the first embodiment for which a simulation has been carried out.
Figure 12:
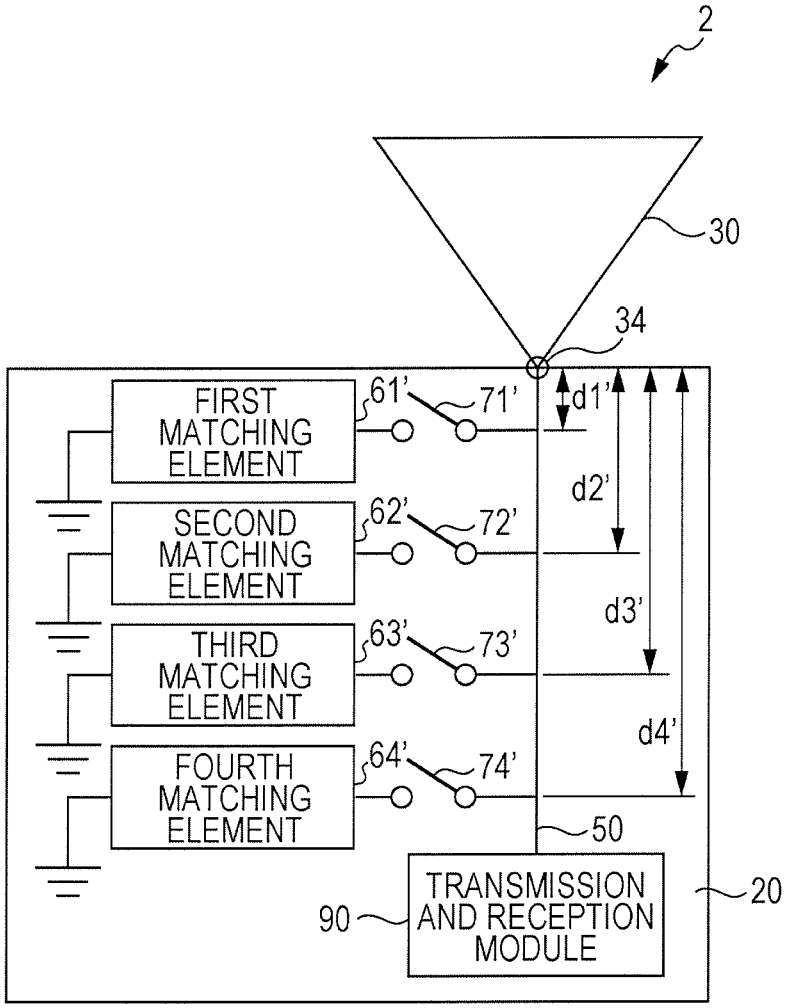
FIG. 12 is a circuit diagram of an antenna device for comparison for which a simulation has been carried out.

FIG. 9 is a first explanatory view of dimensions of each part of the antenna device of the first embodiment for which a simulation has been carried out. FIG. 10 is a second explanatory view of dimensions of each part of the antenna device of the first embodiment for which a simulation has been carried out. FIG. 11 is a third explanatory view of dimensions of each part of the antenna device of the first embodiment for which a simulation has been carried out. FIG. 12 is a circuit diagram of an antenna device for comparison for which a simulation has been carried out.

As illustrated in FIGS. 9 to 11, the substrate 10 may be 50 mm in width, 115 mm in height, and 1.0 mm in thickness. The substrate 10 may include specific inductive capacity of 4 and dielectric loss of 0.01.

The grounding conductor 20 may be disposed at the depth of 0.1 mm from the surface of the substrate 10 with which the feeder wire 50 is in contact. The grounding conductor 20 may be 50 mm in width, 100 mm in height, and 0.035 mm in thickness.

The first antenna element 30 may be 15 mm in height, 29 mm in width, and 0.035 mm in thickness. The length of the first antenna element 30 extending vertically (in the Z-axis direction) from the surface of the substrate 10 may be 3.0 mm and the height of the side of a notch of the first antenna element 30 situated on the side opposite to the side tilted toward the substrate 10 may be 3.0 mm.

A line width of the second antenna element 40 may be 0.5 mm. The first straight portion 41 may be 21 mm in length and the second straight portion 42 may be 15 mm in length.

Conductivity of the grounding conductor 20, the first antenna element 30 and the second antenna element 40 may be $5.96\times10^7$ S/m.

The first switch 71 may be disposed at a distance of 1.05 mm (d1=1.05 mm) from the feeding point 34. The second switch 72 may be disposed at a distance of 13.65 mm (d2=13.65 mm) from the feeding point 34.

An inductance value of the first matching element 61 may be 2.25 nH and an inductance value of the second matching element 62 may be 4.2 nH.

As illustrated in FIG. 12, the antenna device 2 for comparison includes no second antenna element 40. The antenna device 2 may include a first switch 71' to a fourth switch 74' in place of the first switch 71 and the second switch 72. The antenna device 2 may include a first matching element 61' to a fourth matching element 64' corresponding to each of the first switch 71' to the fourth switch 74'.

The first switch 71' may be disposed at a distance of 2.85 mm from the feeding point 34 (d1'=2.85 mm). The second switch 72' may be disposed at a distance of 8.35 mm from the feeding point 34 (d2'=8.35 mm). The third switch 73' may be disposed at a distance of 21.25 mm from the feeding point 34 (d3'=21.25 mm). The fourth switch 74' may be disposed at distance of 29.05 mm from the feeding point 34 (d4'=29.05 mm).

An inductance value of the first matching element 61' may be 4.8 nH and an inductance value of the second matching element 62' may be 26.2 nH. An inductance value of third matching element 63' may be 4.6 nH and an inductance value of the fourth matching element 64' may be 3.4 nH.

The arrangement of each part of the antenna device 2 for comparison other than those described above and setting values of parameters are the same as those of the antenna device 1. The setting values of various parameters described above are illustrative only: it is not meant that the antenna device 1 of the first embodiment does not have desirable antenna characteristics unless the above-described setting values are set.

Figure 13:
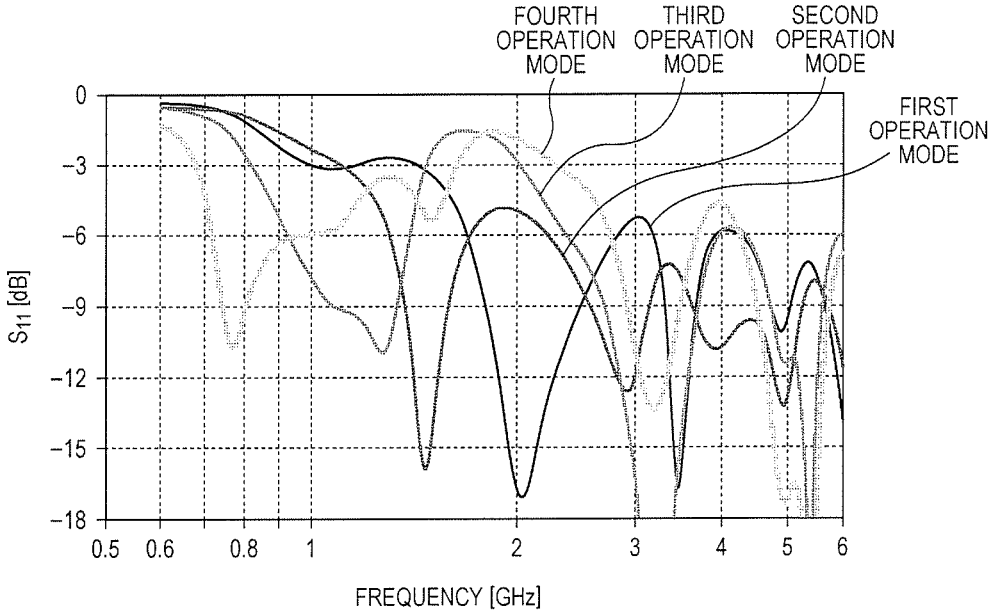
FIG. 13 is a frequency characteristic diagram of a reflection coefficient $S_{11}$ of the antenna device of the first embodiment.
Figure 14:
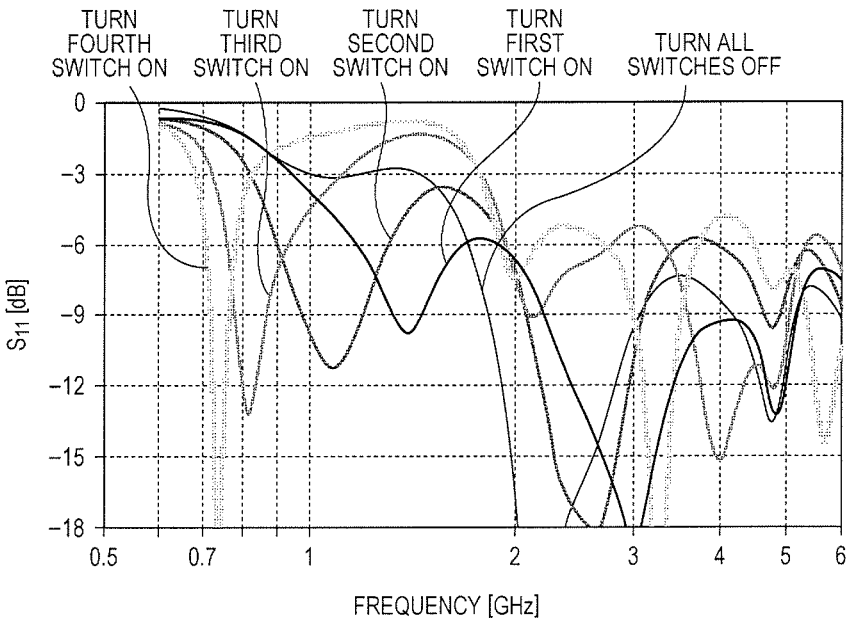
FIG. 14 is a frequency characteristic diagram of a reflection coefficient $S_{11}$ of an antenna device for comparison.

FIG. 13 is a frequency characteristic diagram of a reflection coefficient $S_{11}$ of the antenna device of the first embodiment. FIG. 14 is a frequency characteristic diagram of a reflection coefficient $S_{11}$ of an antenna device for comparison. In FIGS. 13 and 14, a horizontal axis corresponds to a frequency (GHz) and a vertical axis corresponds to a reflection coefficient $S_{11}$ (dB).

For example, when the antenna device 1 of the first embodiment and the antenna device 2 for comparison are compared regarding a frequency band in which reflection coefficient $S_{11}$ is −6 dB or smaller, the frequency band of the reflection coefficient $S_{11}$ in a measurement frequency (0.6 GHz to 6 GHz) is substantially the same. Therefore, it is understood from FIGS. 13 and 14 that the antenna device 1 of the embodiment is superior to the antenna device 2 for comparison in that the number of switches formed in the feeder wire 50 may be reduced and that the maximum distance from the feeder wire 50 to the switch may be shortened.

Figure 15:
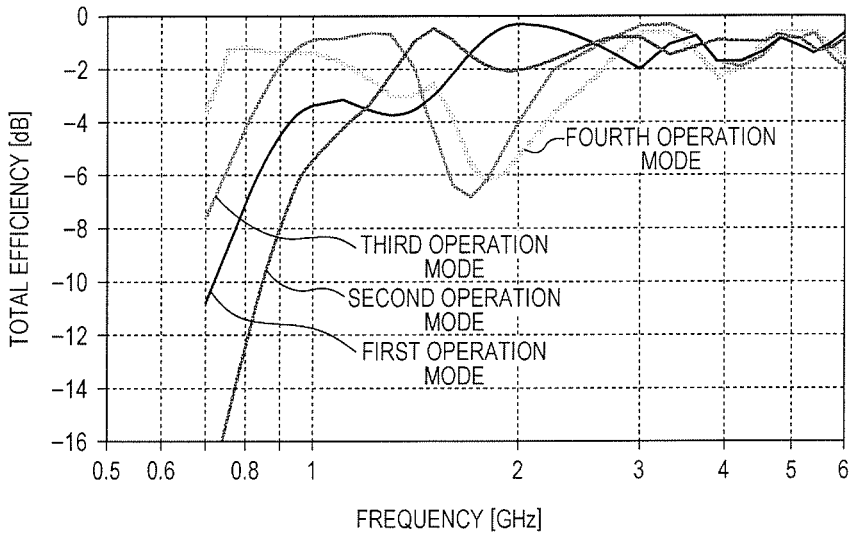
FIG. 15 is a frequency characteristic diagram of a total efficiency of the antenna device of the first embodiment.
Figure 16:
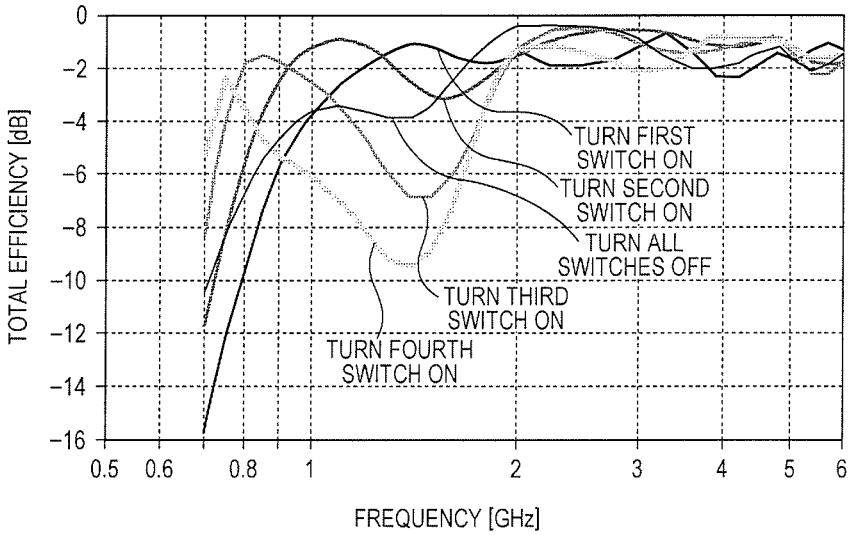
FIG. 16 is a frequency characteristic diagram of a total efficiency of the antenna device for comparison.

FIG. 15 is a frequency characteristic diagram of a total efficiency of the antenna device of the first embodiment. FIG. 16 is a frequency characteristic diagram of a total efficiency of the antenna device for comparison. In FIGS. 15 and 16, a horizontal axis corresponds to a frequency (GHz) and a vertical axis corresponds to total efficiency (dB).

For example, when the antenna device 1 of the first embodiment and the antenna device 2 are compared regarding the total efficiency in the low frequency band, the total efficiency in the low frequency band is reduced gradually in the antenna device 2 even if the switching is made as illustrated in FIG. 16. As illustrated in FIG. 15, in the antenna device 1 according to the first embodiment, a decrease in total efficiency in the low frequency band is controlled by switching the operation modes. Therefore, it is understood from FIGS. 15 and 16 that the antenna device 1 of the embodiment is superior to the antenna device 2 for comparison in that deterioration in antenna characteristics in the low frequency band is controlled.

A design procedure of the antenna device 1 according to the first embodiment will be described.

Figure 17:
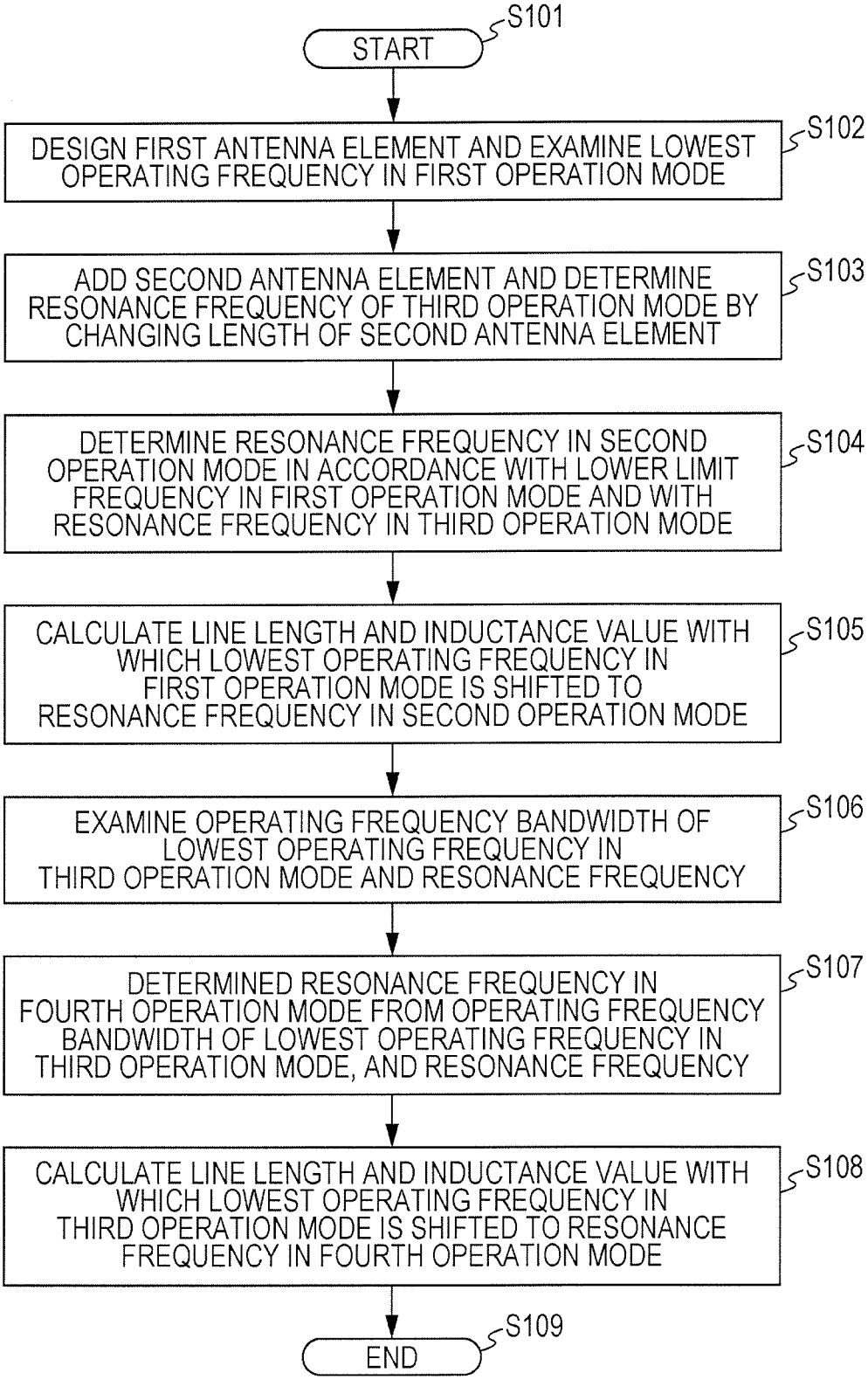
FIG. 17 is a diagram illustrating an example of a design procedure of the antenna device according to the first embodiment.

FIG. 17 is a diagram illustrating an example of a design procedure of the antenna device according to the first embodiment.

When a design of the antenna device 1 according to the first embodiment is started (step S101), a model of the first antenna element 30 may be designed in step S102.

Figure 18:
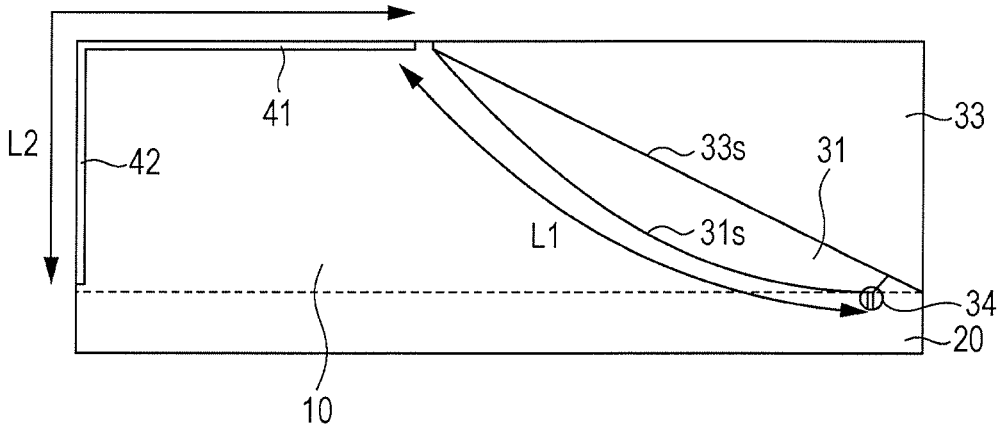
FIG. 18 is an explanatory view of the length of each antenna element according to the first embodiment.
Figure 19:
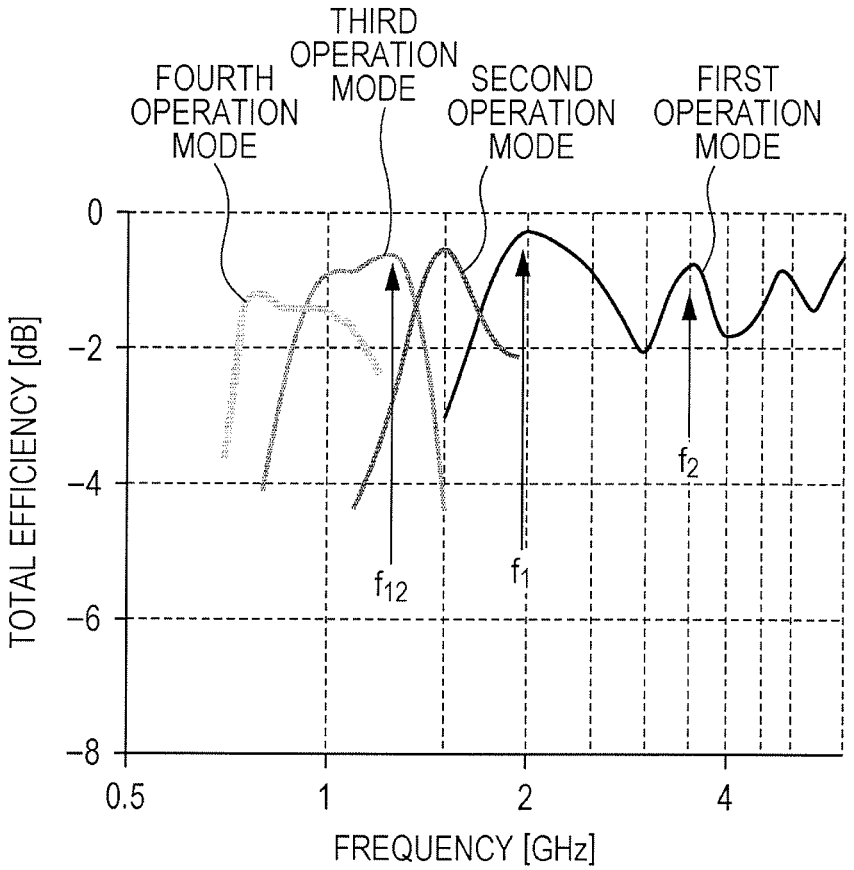
FIG. 19 is an explanatory view of a resonance frequency of an antenna according to the first embodiment.

FIG. 18 is an explanatory view of the length of each antenna element according to the first embodiment. FIG. 19 is an explanatory view of a resonance frequency of an antenna according to the first embodiment. As described above, the first antenna element 30 may be a wideband antenna of ¼ wavelength in the present embodiment. Then, let a basic resonance frequency in the first operation mode illustrated in FIG. 19 be denoted by $f_1$ and let the velocity of light be denoted by c, the length L1 of the side 31*s* of the projecting-shaped first antenna element 30 tilted toward the substrate 10 satisfies the relational expression expressed by the following Equation (7).

$$L1 = \frac{c}{f_1}\frac{1}{4} \tag{7}$$

After the first antenna element 30 is designed, the lowest operating frequency of the first antenna element 30 is examined. That is, the lowest frequency of the operating frequency band including the basic resonance frequency in the first operation mode is examined using an electromagnetic field simulation. The operating frequency is, for example, a frequency of which a reflection coefficient $S_{11}$ is −6 dB or smaller. The operating frequency band including the basic resonance frequency is a frequency band in which the basic resonance frequency is the peak of the antenna characteristics among the entire operating frequency band of the antenna that may change periodically.

In step S103, a model of the second antenna element 40 may be added. Then a basic resonance frequency of an antenna model in which the first antenna element 30 and the second antenna element 40 are connected may be determined while changing the antenna length of the model of the second antenna element 40. That is, the basic resonance frequency in the third operation mode may be determined. In particular, the basic resonance frequency in the third operation mode may be determined such that the operating frequency band including the basic resonance frequency of the third operation mode is formed with a frequency space for an operating frequency bandwidth including the basic resonance frequency of the third operation mode being formed from the lowest operating frequency of the first operation mode.

In step S103, the following points will be considered.

Figure 20:
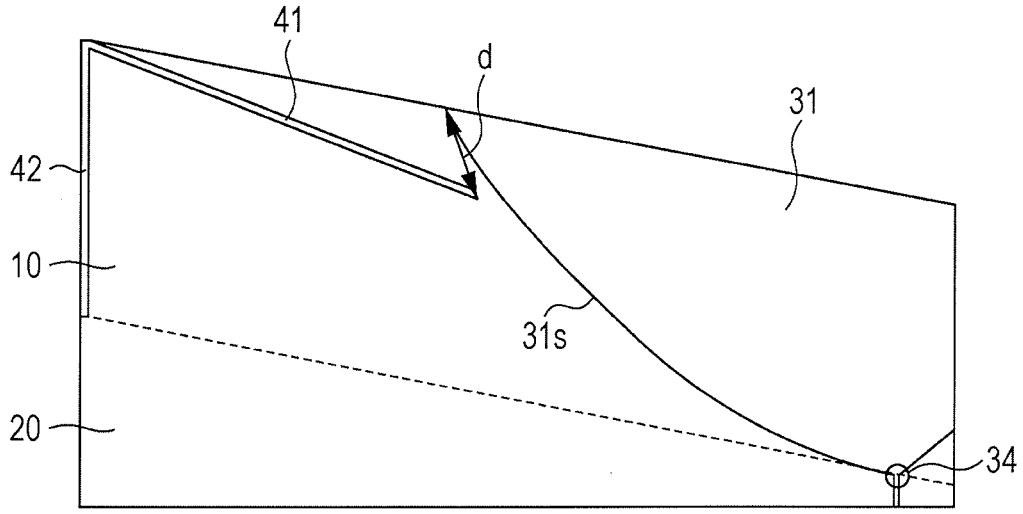
FIG. 20 is an explanatory view of a connecting position of a first antenna element and a second antenna element.
Figure 21:
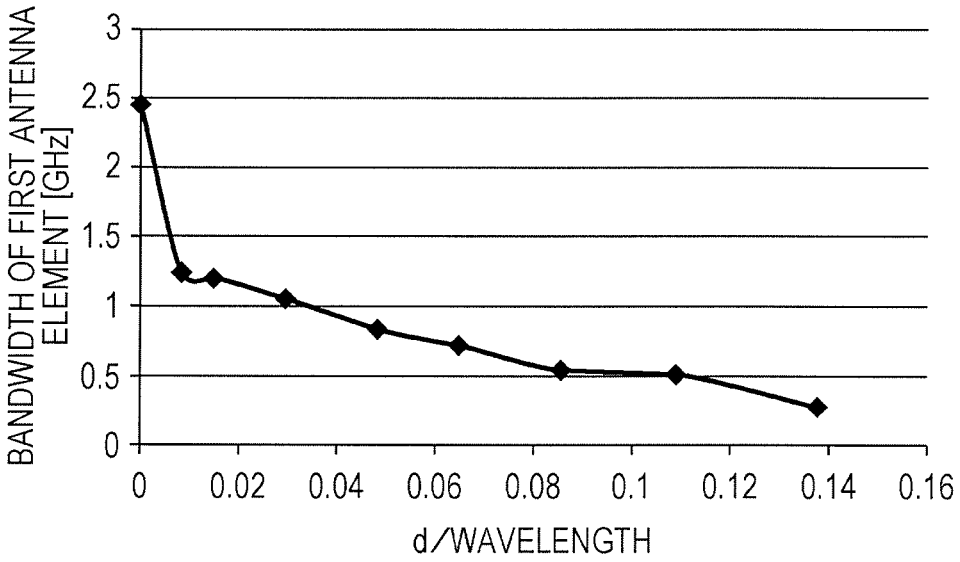
FIG. 21 is a relationship diagram between a connecting position of the second antenna element and an operating frequency bandwidth of the first antenna element.

FIG. 20 is an explanatory view of a connecting position of a first antenna element and a second antenna element. FIG. 21 is a relationship diagram between a connecting position of the second antenna element and an operating frequency bandwidth of the first antenna element. As illustrated in FIG. 20, let a distance from a position of the first antenna element furthest from the feeding point 34 to a position at which the second antenna element 40 is connected to the first antenna element 30 be denoted by d. That is, a distance from a position of the fan-shaped portion 31 furthest from the feeding point 34 to one end of the first straight portion 41 near the fan-shaped portion 31 is denoted by d. As illustrated in FIG. 21, as the distance d becomes large, the operating frequency bandwidth of the first antenna element 30, which is the wideband antenna, becomes narrow, whereby antenna characteristics deteriorate. Thus, the smaller the distance d, the better: preferably, the distance d is smaller than a wavelength λ/200. That is, one end of the first straight portion 41 connected to the fan-shaped portion 31 via the third switch 73 is preferably disposed at a position close to a position of the fan-shaped portion 31 far from the feeding point 34.

As described above, the antenna in which the first antenna element 30 and the second antenna element 40 are connected is a monopole antenna of a ¼ wavelength in the present embodiment. Then, the sum of the length L1 of the side 31*s*, which may determine the lowest operating frequency of the first antenna element 30, and the length L2 of the second antenna element 40, which is the total of the length of the first straight portion 41 and the second straight portion 42, satisfy the relational expression expressed by the following Equation (8).

$$L1 + L2 = \frac{c}{f_{12}}\frac{1}{4} \tag{8}$$

$f_{12}$ in Equation (8) is the basic resonance frequency in the third operation mode illustrated in FIG. 19.

When the second antenna element 40 is disposed at the connecting position described above with reference to FIGS. 20 and 21, resonance of a ½ wavelength as illustrated by $f_2$ in FIG. 19 is produced also in the first operation mode due to existence of the second antenna element 40. If the resonance frequency $f_2$ is close to the basic resonance frequency $f_1$ of the first operation mode, total efficiency in the frequency band between the basic resonance frequency $f_1$ and the resonance frequency $f_2$ may deteriorate significantly. Since the resonance frequency $f_2$ is determined in accordance with the distance L2, the resonance frequency $f_2$ and the distance L2 preferably satisfy relational expression expressed by the following Equation (9) in order to increase the distance between the basic resonance frequency $f_1$ and the resonance frequency $f_2$.

$$L2 < \frac{c}{f_2}\frac{1}{2} \tag{9}$$

As is obvious from FIG. 21, the basic resonance frequency $f_1$ and the resonance frequency $f_2$ satisfy the following relational expression.

$$\frac{f_1}{f_2} \equiv \alpha > 1 \tag{10}$$

Then, on the basis of Equation (7), Equation (9), and Equation (10), the distance L1 and the distance L2 desirably satisfy the relational expression expressed by the following Equation (11).

$$\frac{L2}{L1} < \frac{2f_1}{f_2} = \frac{2}{\alpha} < 2 \tag{11}$$

$$L2 < 2 \times L1$$

In step S104, the basic resonance frequency in the second operation mode may be determined using the lowest operating frequency in the first operation mode and the basic resonance frequency in the third operation mode. That is, the basic resonance frequency of the second operation mode may be determined such that the second operation mode is performed between the lowest operating frequency of the first operation mode and the highest operating frequency of the operating frequency band including the basic resonance frequency of the third operation mode. For example, the basic resonance frequency of the second operation mode is determined for a frequency of a value obtained by dividing the sum of the lowest operating frequency in the first operation mode and the basic resonance frequency in the third operation mode by 2.

In step S105, the length and an inductance value of the feeder wire 50, with which the lowest operating frequency of the first operation mode is shifted to the basic resonance frequency of the second operation mode, may be calculated. The length of the feeder wire 50 to be calculated refers to the distance d1 of the feeder wire 50 from the feeding point 34 to a position at which the first switch 71 is provided. The inductance value to be calculated is an inductance value of the first matching element 61 connected between the feeder wire 50 and the grounding conductor 20 at the distance d1. The distance d1 is calculated on the basis of, for example, Equation (2) described above. In order to reduce loss of the line as described above while referring to FIG. 8, it is desirable to select the shorter one of the two solutions of Equation (2). The inductance value of the first matching element 61 is calculated on the basis of Equation (4) and Equation (5) described above.

In step S106, a bandwidth of the operating frequency bandwidth including the basic resonance frequency in the third operation mode and the lower limit frequency of the operating frequency band may be examined using an arbitrary electromagnetic field simulation.

In step S107, the basic resonance frequency in the fourth operation mode may be determined using the bandwidth of the operating frequency band including the basic resonance frequency in the third operation mode and the lower limit frequency of the operating frequency band. In particular, the basic resonance frequency in the fourth operation mode may be determined such that the operating frequency band, including the basic resonance frequency of the fourth operation mode, is formed with a frequency space for an operating frequency bandwidth including the basic resonance frequency of the fourth operation mode being formed from the lowest operating frequency of the third operation mode.

In step S108, the length and an inductance value of the feeder wire 50, with which the lowest operating frequency of the third operation mode is shifted to the basic resonance frequency of the fourth operation mode, may be calculated. The length of the feeder wire 50 to be calculated refers to the distance d2 of the feeder wire 50 from the feeding point 34 to a position at which the second switch 72 is provided. The inductance value to be calculated is an inductance value of the second matching element 62 connected between the feeder wire 50 and the grounding conductor 20 at the distance d2. The distance d2 is calculated on the basis of, for example, Equation (2) described above. In order to reduce loss of the line, it is desirable to select the shorter one of the two solutions of Equation (2). The inductance value of the second matching element 62 is calculated on the basis of Equation (4) and Equation (5) described above.

When the process at step S108 is completed, the design of the antenna device 1 may be completed (step S109). If the design procedure of such an antenna device 1 is performed, the distance d1 calculated at step S104 becomes shorter than the distance d2 calculated at step S107.

Figure 22:
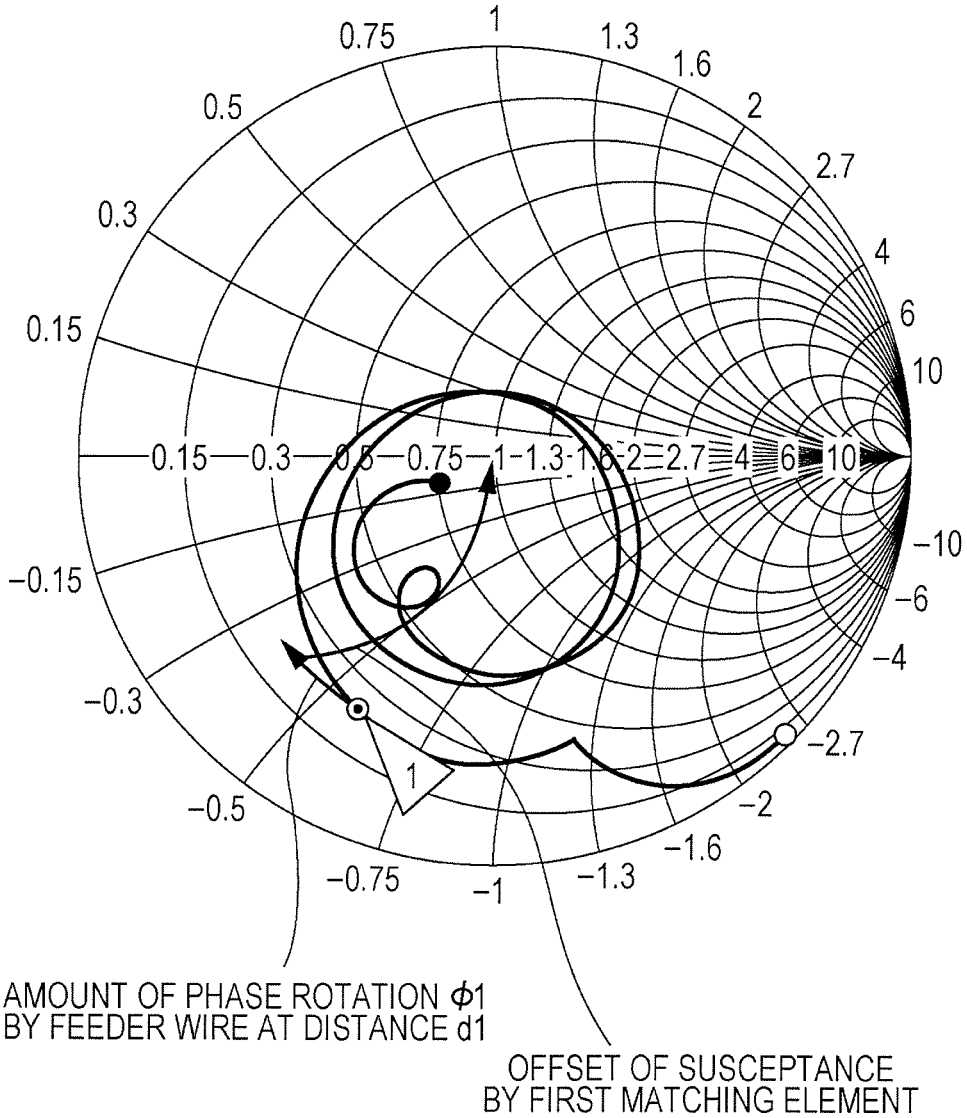
FIG. 22 is an explanatory view of impedance matching in a second operation mode.
Figure 23:
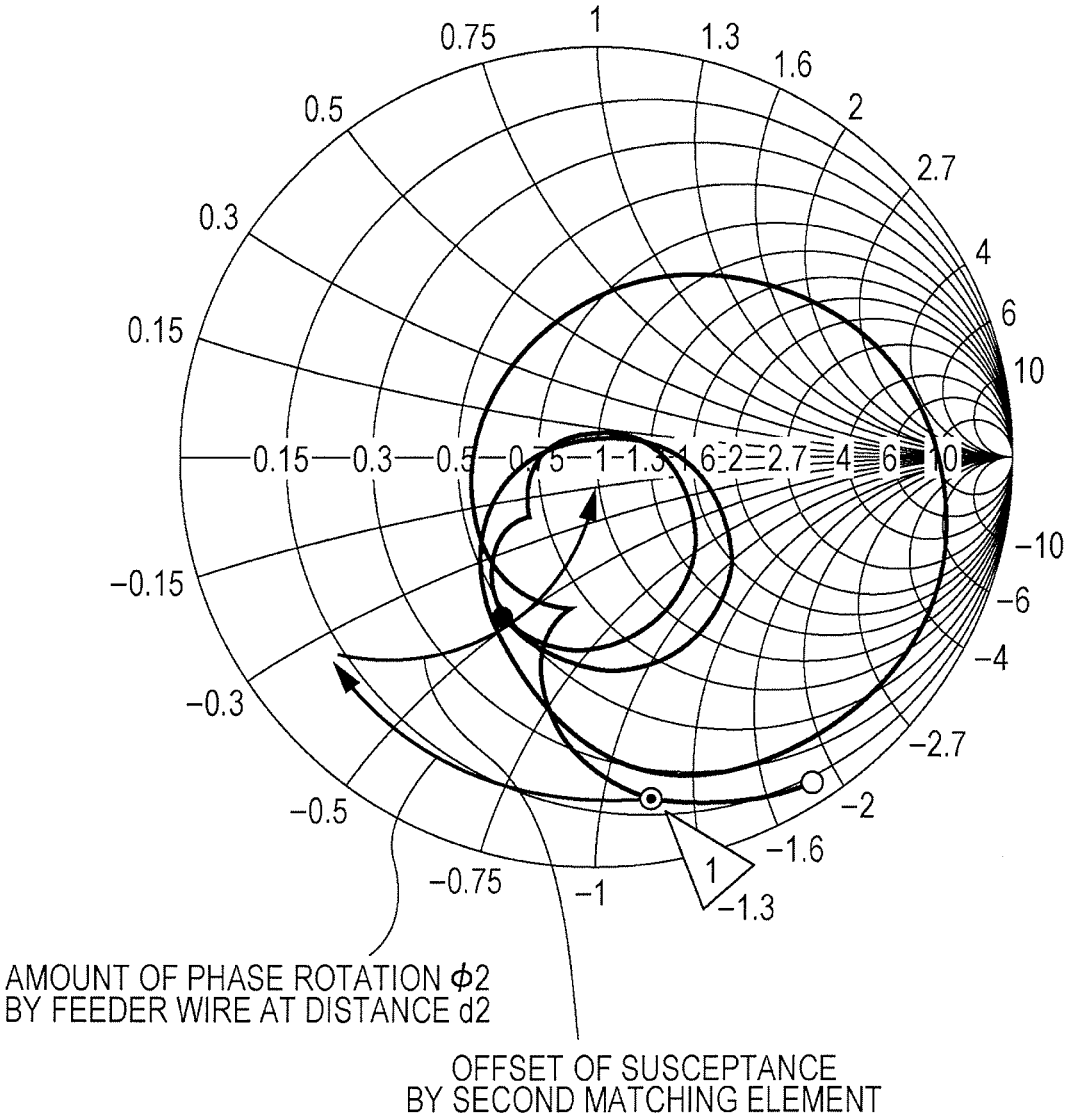
FIG. 23 is an explanatory view of impedance matching in a fourth operation mode.

FIG. 22 is an explanatory view of impedance matching in a second operation mode. FIG. 23 is an explanatory view of impedance matching in a fourth operation mode. As will be understood from a locus of impedance on a Smith chart of FIGS. 22 and 23, a phase of antenna impedance is rotated by the feeder wire 50 at the distance d1 or by the feeder wire 50 at the distance d2. Then capacitive susceptance is offset by the first matching element 61 or the second matching element 62 and antenna impedance is matched to impedance of external circuits, such as 50Ω.

When a locus of impedance of FIG. 22 and a locus of impedance of FIG. 23 are compared, an amount of phase rotation $\phi 2$ of impedance in the fourth operation mode, which operates at the low frequency, is greater than an amount of phase rotation $\phi 1$ of impedance in the second operation mode. Therefore, the distance d2 is longer than the distance d1.

As described above, according to the first embodiment, a small-sized antenna device with desirable antenna characteristics in a wider frequency band may be implemented.

For example, the first antenna element 30, which is a wideband antenna, is bent over the substrate 10 while keeping its surface area. Therefore, the antenna device 1 according to the first embodiment may include desirable antenna characteristics over a wider band and, at the same time, may be reduced in size.

The antenna device 1 according to the first embodiment may include a linear second antenna element 40 in addition to the first antenna element 30, which is a wideband antenna. By coupling the first antenna element 30 and the second antenna element 40, radiation resistance in the low frequency band may be increased and antenna characteristics in the low frequency band may be improved.

Further, in order to perform impedance matching in the low frequency band of the antenna, in which the first antenna element 30 is used, the first matching element 61 and the first switch 71 are provided. The second matching element 62 and the second switch 72 are provided for the impedance matching in the low frequency band of the antenna, in which the first antenna element 30 and the second antenna element 40 are connected. Then the first operation mode, in which the first antenna element 30 is used, and the second operation mode, in which the first switch 71 is turned ON so that the first matching element 61 is used, are switched. Further, the third operation mode, in which the third switch 73 is turned ON and a monopole antenna formed by connecting the first antenna element 30 and the second antenna element 40 is used, and the fourth operation mode, in which the second switch 72 and the third switch 73 are turned ON and the second matching element 62 is used, are switched. According to such a configuration, the number of switches provided for performing matching antenna impedance in the feeder wire 50 may be reduced. Further, the maximum distance of the feeder wire 50 from the feeding point 34 to the switch may be shortened and deterioration of antenna characteristics under the influence of conductor loss of the line may be controlled.

In the above-described example, the number of switches is two and the number of matching elements connected to the feeder line in an above-described example is two. However, in order to further improve antenna characteristics in the low frequency band, three or more switches and matching elements may be included in the antenna device.

Second Embodiment

In the first embodiment, the antenna device 1 may be configured to be switched among the first to the fourth operation modes, as illustrated in FIGS. 6 and 7.

Figures 24, 25:
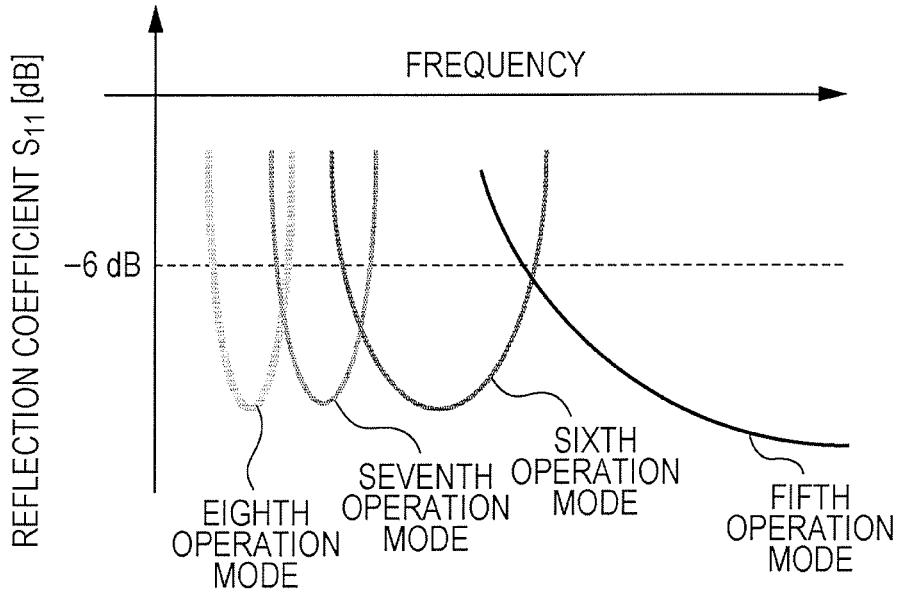
FIG. 24 is an explanatory view of an operation mode of an antenna device according to a second embodiment.
FIG. 25 is an explanatory view of a relationship between the operation mode illustrated in FIG. 24 and frequency characteristics of a reflection coefficient $S_{11}$.

In a second embodiment, an antenna device 1 may be configured to be switched among a fifth to an eighth operation modes, as illustrated in FIGS. 24 and 25.

FIG. 24 is an explanatory view of an operation mode of an antenna device according to a second embodiment. FIG. 25 is an explanatory view of a relationship between the operation mode illustrated in FIG. 24 and frequency characteristics of a reflection coefficient $S_{11}$.

In the fifth operation mode illustrated in FIG. 24, as in the first operation mode illustrated in FIG. 6, the first switch 71, the second switch 72, and the third switch 73 are controlled to be turned OFF in accordance with a control signal from the control circuit. Therefore, in the first operation mode, since the third switch 73 is OFF, only the first antenna element 30 is used as an antenna of the antenna device 1. Since the first switch 71 and the second switch 72 are OFF, matching of antenna impedance, for which the first matching element 61 and second matching element 62 are used, is not performed.

As described above, the first antenna element 30 has a shape suitable for transmitting and receiving wideband wireless signals. Then, as illustrated in FIG. 25, the reflection coefficient $S_{11}$ of the antenna of the antenna device 1 in the fifth operation mode is desirable over a wider band and is, for example, −6 dB or smaller over a wider band, which is an indicator of desirability.

In a sixth operation mode illustrated in FIG. 24, the first switch 71 and the second switch 72 are controlled to be turned OFF and the third switch 73 is controlled to be turned ON in accordance with a control signal from the control circuit. Therefore, in the sixth operation mode, a monopole antenna, constituted by the first antenna element 30 and the second antenna element 40, is used as an antenna of the antenna device 1. Since the first switch 71 and the second switch 72 are OFF, matching of antenna impedance, for which the first matching element 61 and the second matching element 62 are used, is not performed.

As illustrated in FIG. 25, characteristics of reflection coefficient $S_{11}$ in the sixth operation mode are more desirable in the low frequency band than in the fifth operation mode since the third switch 73 is controlled to be turned ON and the length of the antenna is increased. Therefore, in the sixth operation mode, the antenna device 1 is operable at a lower frequency band lower than in the fifth operation mode.

In a seventh operation mode illustrated in FIG. 24, the first switch 71 and the third switch 73 are controlled to be turned ON and the second switch 72 is controlled to be turned OFF in accordance with a control signal from the control circuit. Therefore, in the seventh operation mode, a monopole antenna, constituted by the first antenna element 30 and the second antenna element 40, is used as an antenna of the antenna device 1. Since the first switch 71 is ON, antenna impedance is matched by the feeder wire 50 of a distance d1 from the feeding point 34 to the first switch 71 and the first matching element 61.

As illustrated in FIG. 25, characteristics of reflection coefficient $S_{11}$ in the seventh operation mode are more desirable in the low frequency band than in the sixth operation mode since the first switch 71 is controlled to be turned ON and impedance matching of the antenna is performed. Therefore, in the seventh operation mode, the antenna device 1 is operable at a lower frequency band lower than in the sixth operation mode.

In the eighth operation mode illustrated in FIG. 24, the second switch 72 and the third switch 73 are controlled to be turned ON and the first switch 71 is controlled to be turned OFF in accordance with a control signal from the control circuit. Therefore, in the eighth operation mode, a monopole antenna, constituted by the first antenna element 30 and the second antenna element 40, is used as an antenna of the antenna device 1. Since the second switch 72 is ON, antenna impedance is matched by the feeder wire 50 of the distance d2 from the feeding point 34 to the second switch 72 and the second matching element 62.

As illustrated in FIG. 25, characteristics of reflection coefficient $S_{11}$ in the eighth operation mode are more desirable in the low frequency band than in the seventh operation mode since the second switch 72 is controlled to be turned ON and impedance matching of the antenna is performed. Therefore, in the eighth operation mode, the antenna device 1 is operable at lower a frequency band lower than in the seventh operation mode.

Thus, the antenna device 1 according to the second embodiment uses the first antenna element 30 with desirable antenna characteristics in a wider band as the antenna in the fifth operation mode. In addition, in the sixth operation mode, the antenna device 1 according to the second embodiment uses a monopole antenna, which is formed by connecting the first antenna element 30 and the second antenna element 40, to be usable in the low frequency band having a long electric length.

Therefore, in comparison with an antenna device, which is constituted only by a wideband antenna, such as a UWB antenna, and which performs matching of antenna impedance by sequentially switching a plurality of switches disposed at predetermined distances from the feeding point, the antenna device 1 according to the second embodiment may have improved antenna characteristics in the low frequency band.

In the seventh operation mode, the antenna device 1 according to the second embodiment may perform matching of antenna impedance in the lower frequency band than in the sixth operation mode by the feeder wire 50 of the distance d1 and the first matching element 61 by turning the first switch 71 ON. In addition, in the eighth operation mode, the antenna device 1 according to the second embodiment may perform matching of antenna impedance in the low frequency band than in the seventh operation mode by the feeder wire 50 of the distance d2 and the second matching element 62 by turning the second switch 72 ON. That is, the maximum distance of the feeder wire 50 from feeding point 34 to the switch, so as to obtain desirable antenna characteristics in a predetermined bandwidth in the fifth operation mode to the eighth operation mode, is the distance d2 from the feeding point 34 to the second switch 72.

Thus, the antenna device 1 according to the second embodiment may shorten the distance of the feeder wire from the feeding point to the switch by including the linear second antenna element 40 in addition to the first antenna element 30, which is a wideband antenna, and performing switching control of the operation modes, as described above. Therefore, an increase in loss of the line may be controlled and a decrease in radiant efficiency of the antenna and total efficiency may be controlled.

Figure 26:
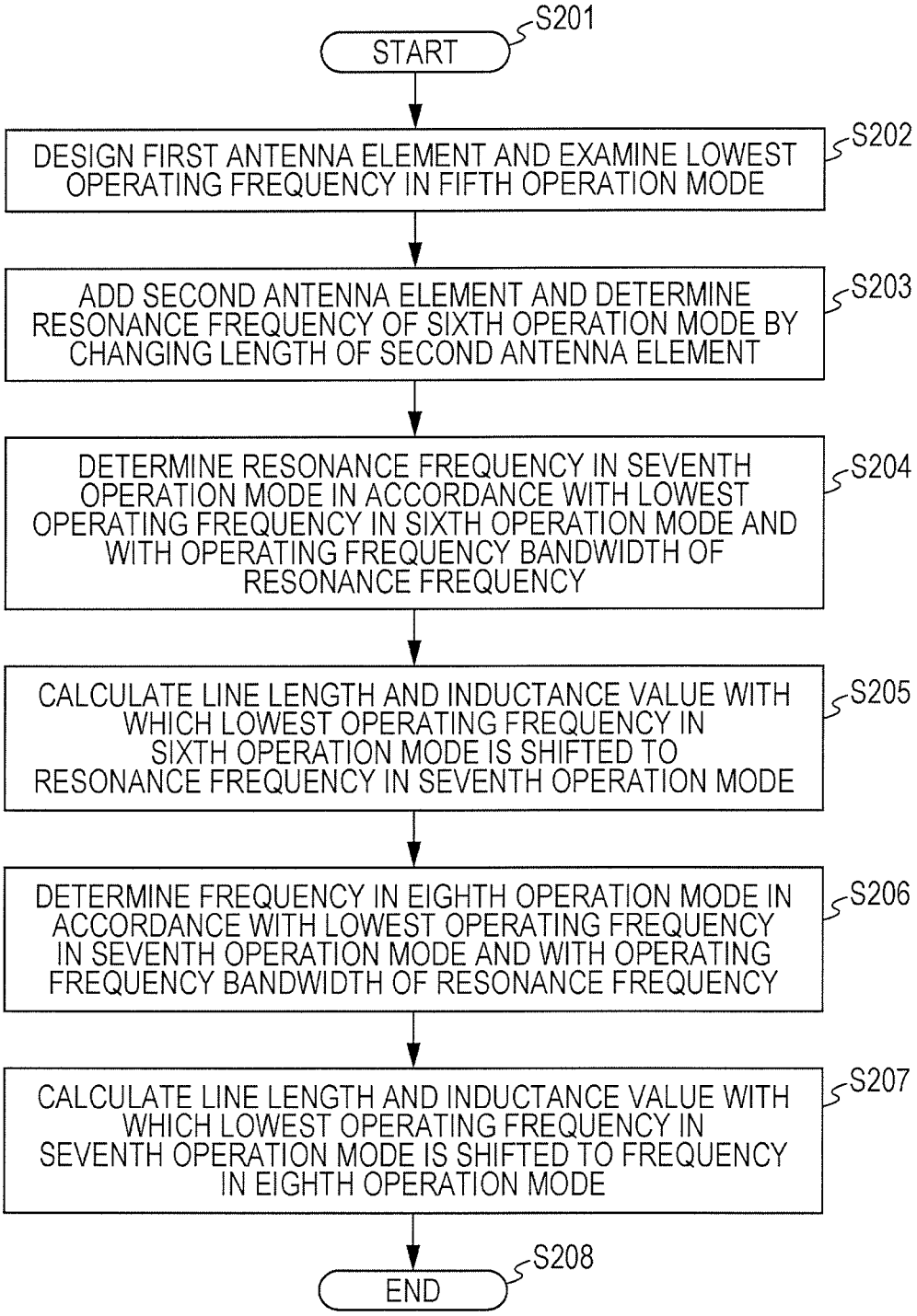
FIG. 26 is a diagram illustrating an example of a design procedure of the antenna device according to the second embodiment.

A design procedure of the antenna device 1 according to the second embodiment will now be described. FIG. 26 is a diagram illustrating an example of a design procedure of the antenna device according to the second embodiment. When a design of the antenna device 1 according to the second embodiment is started (step S201), a model of the first antenna element 30 may be designed in step S202. The first antenna element 30 is a wideband antenna of ¼ wavelength in the present embodiment.

After the first antenna element 30 is designed, the lowest operating frequency of the first antenna element 30 may be examined. That is, the lowest frequency of the operating frequency band, including the basic resonance frequency in the first operation mode, is examined using an electromagnetic field simulation. The operating frequency is, for example, a frequency of which reflection coefficient $S_{11}$ is −6 dB or smaller, as illustrated in FIG. 25.

In step S203, a model of the second antenna element 40 may be added. Then a basic resonance frequency of an antenna model, in which the first antenna element 30 and the second antenna element 40 are connected, may be determined while changing the antenna length of the model of the second antenna element 40. That is, the basic resonance frequency in the sixth operation mode is determined. In particular, the basic resonance frequency in the sixth operation mode is determined such that the operating frequency band including the basic resonance frequency of the sixth operation mode is formed with a frequency space for an operating frequency bandwidth of the sixth operation mode being formed from the lowest operating frequency of the fifth operation mode.

In step S204, the basic resonance frequency in the seventh operation mode may be determined using the bandwidth of the operating frequency band including the basic resonance frequency in the sixth operation mode and the lower limit frequency of the operating frequency band. In particular, the basic resonance frequency in the seventh operation mode is determined such that the operating frequency band, including the basic resonance frequency of the seventh operation mode, is formed with a frequency space for an operating frequency bandwidth including the basic resonance frequency of the seventh operation mode being formed from the lowest operating frequency of the third operation mode.

In step S205, the length and an inductance value of the feeder wire 50, with which the lowest operating frequency of the sixth operation mode is shifted to the basic resonance frequency of the seventh operation mode, are calculated. The length of the feeder wire 50 to be calculated refers to the distance d1 of the feeder wire 50 from the feeding point 34 to a position at which the first switch 71 is provided. The inductance value to be calculated is an inductance value of the first matching element 61 connected between the feeder wire 50 and the grounding conductor 20 at the distance d1. The distance d1 is calculated on the basis of, for example, Equation (2) described above. As described above, it is desirable to select the shorter one of the two solutions of Equation (2). The inductance value of the first matching element 61 is calculated on the basis of Equation (4) and Equation (5) described above.

In step S206, the basic resonance frequency in the eighth operation mode may be determined using the bandwidth of the operating frequency band including the basic resonance frequency in the seventh operation mode and the lower limit frequency of the operating frequency band. In particular, the basic resonance frequency in the eighth operation mode is determined such that the operating frequency band, including the basic resonance frequency of the eighth operation mode, is formed with a frequency space for an operating frequency bandwidth including the basic resonance frequency of the eighth operation mode being formed from the lowest operating frequency of the seventh operation mode.

In step S207, the length and an inductance value of the feeder wire 50, with which the lowest operating frequency of the eighth operation mode is shifted to the basic resonance frequency of the seventh operation mode, are calculated. The length of the feeder wire 50 to be calculated refers to the distance d2 of the feeder wire 50 from the feeding point 34 to a position at which the second switch 72 is provided. The inductance value to be calculated is an inductance value of the second matching element 62 connected between the feeder wire 50 and the grounding conductor 20 at the distance d2. The distance d2 is calculated on the basis of, for example, Equation (2) described above. As described above, it is desirable to select the shorter one of the two solutions of Equation (2). The inductance value of the second matching element 62 is calculated on the basis of Equation (4) and Equation (5) described above.

When the process at step S207 is completed, the design of the antenna device 1 is completed (step S208). When a design procedure of such an antenna device 1 is performed, the distance d1 calculated at step S205 becomes shorter than the distance d2 calculated at step S207.

According to the second embodiment, as in the first embodiment, a small-sized antenna device with desirable antenna characteristics in a wider frequency band may be implemented.

In the above-described example, the number of switches is two and the number of matching elements connected to the feeder wire in an above-described example is two. However, in order to further improve antenna characteristics in the low frequency band, three or more switches and matching elements may be included in the antenna device.

Third Embodiment

In the first and the second embodiment, it is considered that the first switch 71 and the second switch 72 included in the antenna device 1 include neither loss nor reactance. However, actual switches, such as a MEMS switch, may include loss and reactance.

Figure 27:
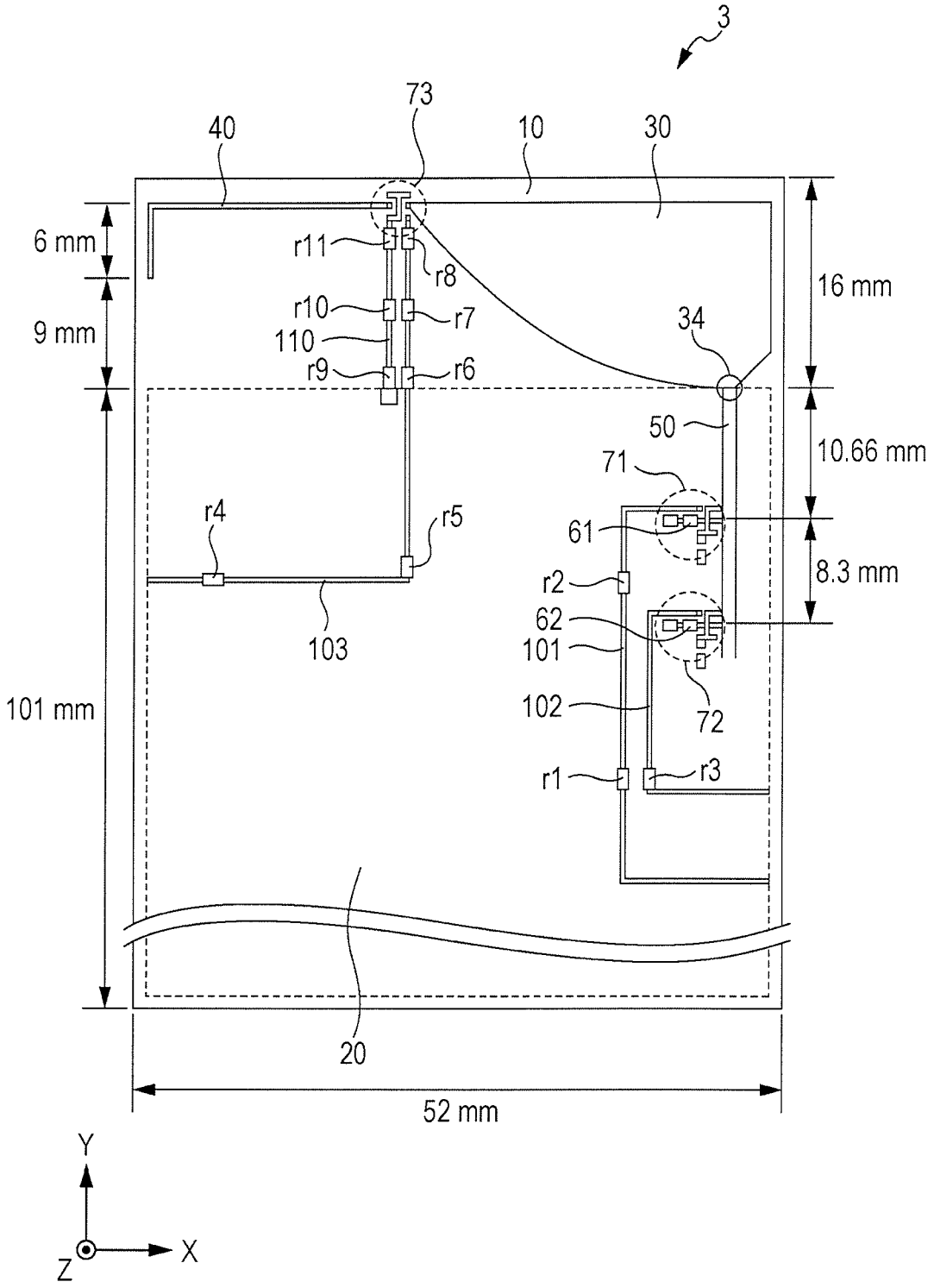
FIG. 27 is a top view of an antenna device according to a third embodiment.
Figure 28:
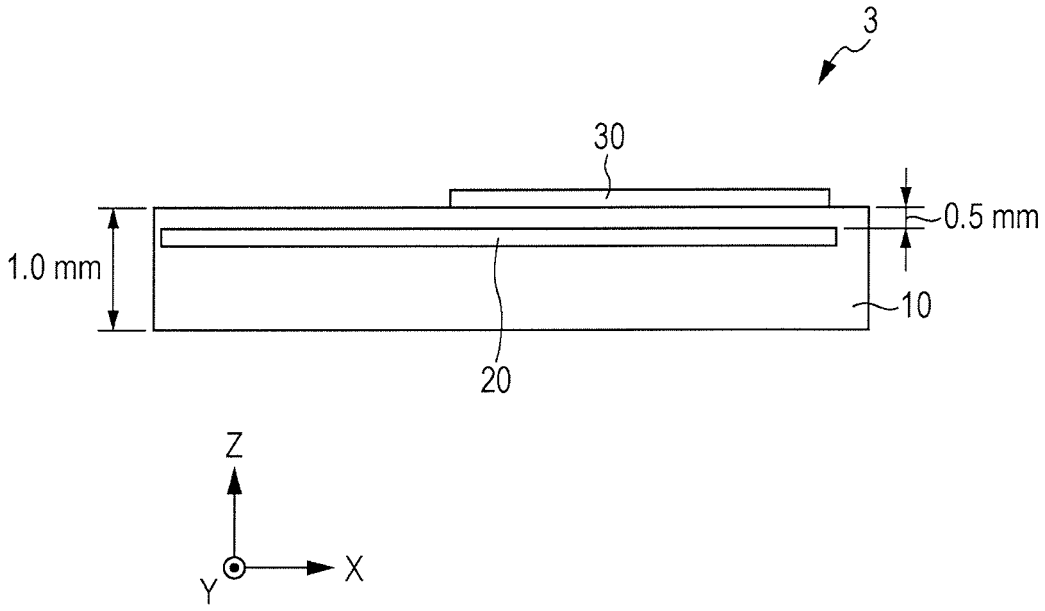
FIG. 28 is a cross-sectional view of the antenna device according to the third embodiment.

An antenna device according to a third embodiment may include a switch that includes loss and reactance. FIG. 27 is a top view of an antenna device according to a third embodiment. FIG. 28 is a cross-sectional view of the antenna device according to the third embodiment. In an antenna device 3 according to the third embodiment illustrated in FIGS. 27 and 28, the same components as those of the antenna device 1 according to the first and the second embodiments are denoted by the same reference numerals.

As illustrated in FIG. 27, the antenna device 3 may include two matching elements 61 and 62 and three switches 71 to 73, which are the same in the antenna device 1. As illustrated in FIG. 27, the antenna device 3 includes a first control wire 101, a second control wire 102, a third control wire 103, and a grounding wire 110.

The first control wire 101 may be coupled to a driving electrode of a first switch 71 and may transmit to the first switch 71 a control signal (a driving current) from a control circuit (not illustrated) with which the first switch 71 is controlled to be turned ON and OFF. The second control wire 102 may be coupled to a driving electrode of a second switch 72 and may transmit to the second switch 72 a control signal (a driving current) from the control circuit with which the second switch 72 is controlled to be turned ON and OFF. The third control wire 103 may be coupled to a driving electrode of a third switch 73 and may transmit to the third switch 73 a control signal (a driving current) from the control circuit with which the third switch 73 is controlled to be turned ON and OFF.

The grounding wire 110 may couple a grounding electrode of the third switch 73 and the grounding conductor 20. In the third switch 73 in the antenna device 3 according to the third embodiment, since the grounding conductor 20 does not exist below as illustrated in FIG. 27, the grounding wire 110 is provided. The grounding electrode of the first switch 71 and the grounding electrode of the second switch 72 are each coupled to the grounding conductor 20.

In the third embodiment, in order to reduce unnecessary resonance of the control wires 101 to 103 and the grounding wire 110, resistance elements r1 to r11 may be coupled to the control wires 101 to 103 and the grounding wire 110 in series, respectively.

In the following, it will be demonstrated through simulation analysis that the antenna device 3, according to the third embodiment, has desirable antenna characteristics. Setting values of parameters of each part of the antenna device 3 during the simulation analysis are as follows.

As illustrated in FIGS. 27 and 28, the substrate 10 may be 52 mm in width, 117 mm in height, and 1.0 mm in thickness. The substrate 10 may include specific inductive capacity of 4 and dielectric loss of 0.01.

The grounding conductor 20 may be disposed at the depth of 0.5 mm from the surface of the substrate 10 with which the feeder wire 50 is in contact. The grounding conductor 20 may be 50 mm in width, 100 mm in height, and 0.035 mm in thickness.

The first antenna element 30 may be 15 mm in height, 29 mm in width, and 0.035 mm in thickness. The length of the first antenna element 30 extending vertically from the surface of the substrate 10 may be 3.0 mm and the height of the side of a notch of the first antenna element 30 situated on the side opposite to the side tilted toward the substrate 10 may be 3.0 mm.

A line width of the second antenna element 40 may be 0.5 mm. The first straight portion 41 may be 21 mm in length, and the second straight portion 42 may be 6 mm in length.

Conductivity of the grounding conductor 20, the first antenna element 30, and the second antenna element 40 may be $5.96\times10^7$ S/m.

The first switch 71 may be disposed at a distance of 10.66 mm (d1=10.66 mm) from the feeding point 34. The second switch 72 may be disposed at a distance of 18.96 mm (d2=18.96 mm) from the feeding point 34.

An inductance value of the first matching element 61 may be 0.4 nH and an inductance value of the second matching element 62 may be 1.3 nH.

The resistance elements r1 to r11 may be 10Ω.

The antenna device 3 may operate in accordance with the fifth to the eighth operation modes described above with reference to FIG. 24.

Figure 29:
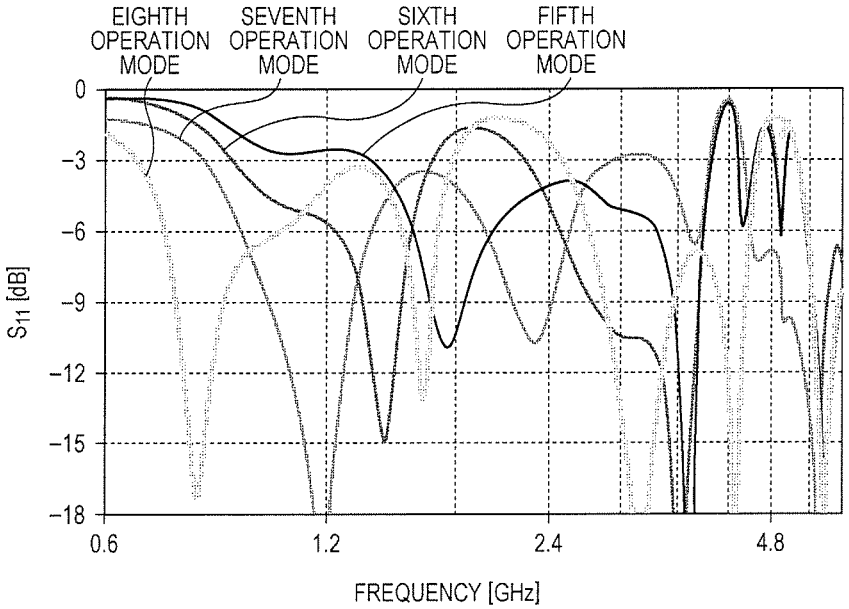
FIG. 29 is a frequency characteristic diagram of a reflection coefficient $S_{11}$ of the antenna device according to the third embodiment.
Figure 30:
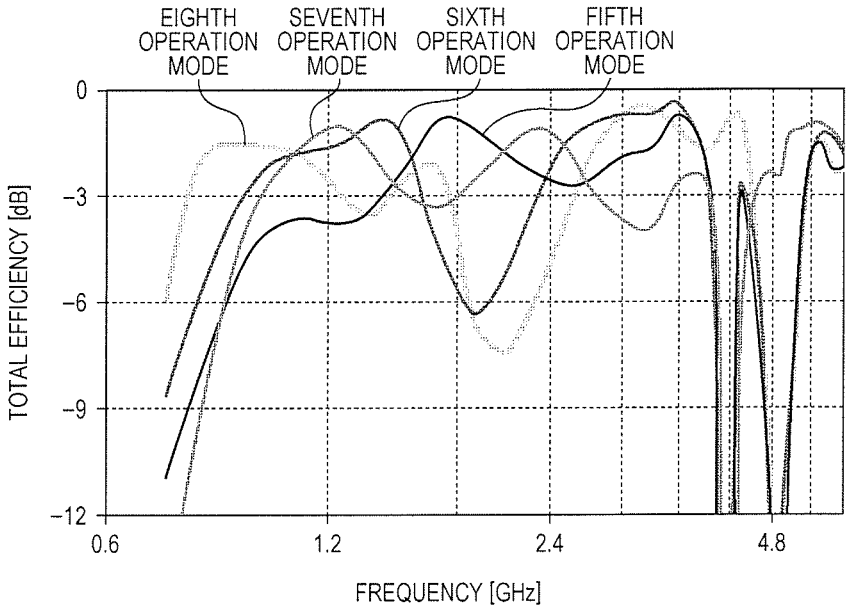
FIG. 30 is a frequency characteristic diagram of total efficiency of the antenna device according to the third embodiment.

FIG. 29 is a frequency characteristic diagram of a reflection coefficient $S_{11}$ of the antenna device according to the third embodiment. FIG. 30 is a frequency characteristic diagram of total efficiency of the antenna device according to the third embodiment.

As illustrated in FIG. 29, the reflection coefficient $S_{11}$ of the antenna device 3 may be kept to be −6 dB or smaller by the switching control of the fifth to the eighth operation modes. As illustrated in FIG. 30, total efficiency of the antenna device 3 may be higher than −3 dB between 0.78 GHz to 6 GHz. The total efficiency is, for example, defined by the specification of 3GPP and may be high enough to cover bands 1 to 11, bands 18 to 27, and bands 33 to 43 which are used in the LTE. The total efficiency may be high enough to cover 1.563 to 1.578 GHz used for the GPS and 2.402 to 2.480 GHz used for the wireless local area network (WLAN), such as Bluetooth.

From the simulation result of FIGS. 29 and 30 described above, it may be understood that the antenna device 3 provided with a switch including loss and reactance has desirable antenna characteristics over a wider band.

The same advantageous effects as those of the antenna device according to the first embodiment described above may be obtained by the antenna device 3 according to the third embodiment.

Fourth Embodiment

The antenna devices according to the first to the third embodiments may be mounted on a communication devices, such as a personal digital assistant unit.

Figures 31, 32:
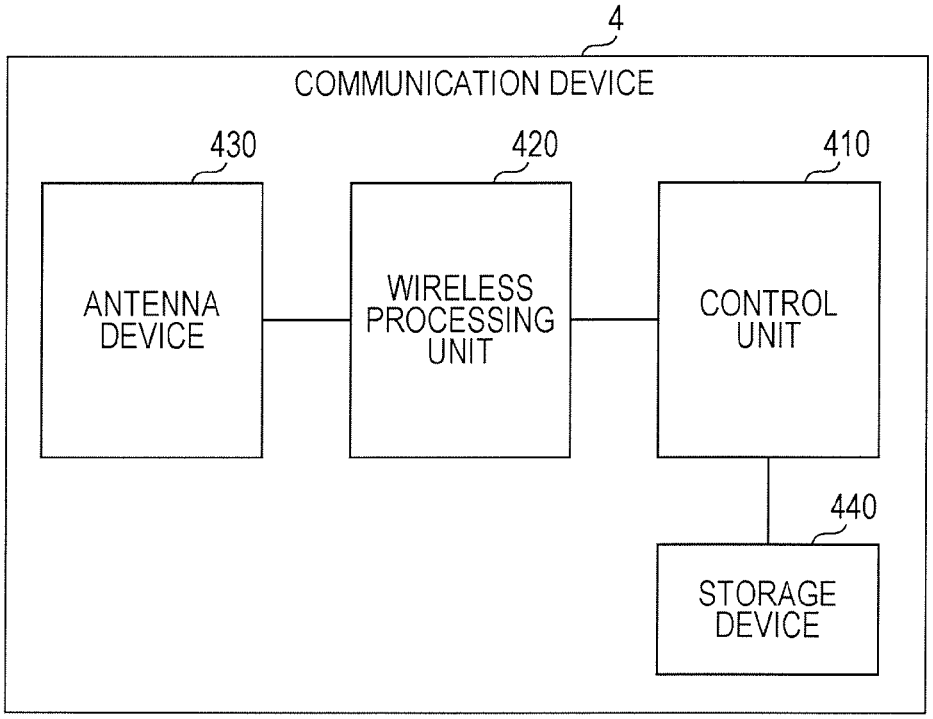
FIG. 31 is a schematic diagram of a communication device including an antenna device according to an embodiment.
FIG. 32 is a diagram illustrating an example of an operation mode management table stored in a storage device.

FIG. 31 is a schematic diagram of a communication device including an antenna device according to an embodiment.

As illustrated in FIG. 31, a communication device 4 according to a fourth embodiment may include a control unit 410, a wireless processing unit 420, an antenna device 430, and a storage device 440.

The antenna device 430 may be an antenna device according to any one of the first to the third embodiments described above. The control unit 410 may be the control circuit described above and the wireless processing unit 420 may be the transmission and reception module 90 described above. The control unit 410, the wireless processing unit 420, and the storage device 440 may be formed as independent circuits or may be formed as an integrated circuit.

The wireless processing unit 420 modulates and multiplexes a transmitted signal received from the control unit 410 in accordance with a predetermined scheme. A predetermined modulation and multiplexing scheme may include a single carrier frequency division multiplexing (SC-FDMA).

The wireless processing unit 420 may superimpose a modulated and multiplexed signal on a carrier wave having a radio frequency designated by the control unit 410. The wireless processing unit 420 may amplify the signal superimposed on the carrier wave into a desired level by a high power amplifier (not illustrated), and may output the amplified signal to the antenna device 430.

The wireless processing unit 420 may amplify the signal received from the antenna device 430 by a low noise amplifier (not illustrated). The wireless processing unit 420 may convert the frequency of the received signal from the radio frequency into the baseband frequency by multiplying, by a periodic signal having an intermediate frequency, a signal which has a radio frequency designated by the control unit 410 among the amplified received signal. The wireless processing unit 420 may separate the received signals in accordance with a predetermined multiplexing scheme and demodulate each of the separated signals. The wireless processing unit 420 may output the demodulated signals to the control unit 104. A multiplexing scheme to the received signals may include an orthogonal frequency-division multiplexing (OFDM).

The antenna device 430 may emit the signals output from the wireless processing unit 420 to the air. The antenna device 430 may receive signals transmitted from other communication devices and may output the received signals to the wireless processing unit 420.

The antenna device 430 may include a first antenna element, which is a wideband antenna, and a second antenna element, which is a linear antenna. The antenna device 430 may include a switch for switching a connecting state of the first antenna element and the second antenna element. When the first antenna element and the second antenna element are disconnected by the switch, the antenna of the antenna device 430 may serve as a wideband antenna. When the first antenna element and the second antenna element are connected by the switch, the antenna of the antenna device 430 may serve as a monopole antenna.

Further, the antenna device 430 may include a plurality of matching elements, which may be connected to a feeder wire in parallel with one another at predetermined positions, and a switch, which switches a connecting state of each of the matching element and the feeder wire. The antenna device 430 turns any one of the switches ON or OFF in accordance with a control signal received from the control unit 410. The antenna device 430 connects or disconnects the matching element corresponding to a frequency of a carrier wave of the transmitted signals or the received signals to or from the feeder wire, whereby letting impedance of the antenna be matched with the impedance (for example, 50Ω) of external circuits.

The storage device 440 may be, for example, rewritable non-volatile semiconductor memory. Various kinds of information used for the control in communication with other communication devices may be stored by storage device 440. For example, an operation mode management table representing relationships between a plurality of operating frequency bands and ON states and OFF states of each corresponding switch may be stored in the storage device 440.

FIG. 32 is a diagram illustrating an example of an operation mode management table stored in a storage device.

As illustrated in FIG. 32, a plurality of operating frequency bands may be recorded on the operation mode management table. Operation modes that correspond to each operating frequency band may be recorded on the operation mode management table. In an example illustrated in FIG. 32, the first to the fourth operation modes described with reference to FIG. 6 may be stored in correlation with each of the operating frequency bands. As illustrated in FIG. 32, each operation mode may be a predetermined combination of an ON state or an OFF state of a third switch, which connects or disconnects the first antenna element to or from the second antenna element, and ON states or OFF states of a first and a second switches, which connect or disconnect a first and a second matching elements to or from the feeder wire.

The operation mode management table illustrated in FIG. 32 is illustrative only. For example, the operation mode management table may be a table representing relationships between an identification number of a communication application performed by the communication device 4 and an operation mode corresponding to a frequency band used in the communication application.

The control unit 410 may perform a process for wirelessly connecting the communication device 4 to other communication devices. For example, if the communication device 4 is a mobile terminal device of a mobile communications system, such as a personal digital assistant unit, the control unit 410 performs processes of, for example, location registration, call control, handover and transmission power control. The control unit 410 may generate a control signal for performing a wireless connecting process between the communication device 4 and other communication devices. The control unit 410 may perform a process in accordance with a control signal received from other communication devices.

The control unit 410 may create transmission data, such as an audio signal and a data signal, obtained via a user interface (not illustrated), such as a microphone (not illustrated) and a keypad. The control unit 410 may then perform an information source encoding process to the transmission data. The control unit 410 may generate a transmitted signal including the transmission data and the control signal and may perform a transmission process, such as an encoding process for error correction, to the generated transmitted signal. The control unit 410 may output, to the wireless processing unit 420, the transmitted signal to which the transmission process has been performed.

Further, the control unit 410 may receive a signal, which has been received from other wirelessly connected communication devices, where the signal has been demodulated by the wireless processing unit 420, and may perform a reception process, such as error correction decoding and information source decoding, to the signal. The control unit 410 may acquire an audio signal and a data signal from the decoded signal. The control unit 410 may reproduce the acquired audio signal by a speaker (not illustrated) and may display the acquired data signal on a display (not illustrated).

The control unit 410 may specify a frequency band used for the communication with other communication devices in accordance with a manipulation signal input via a user interface (not illustrated) or a command from a communication application performed by the control unit 410. The control unit 410 may specify an operation mode corresponding to a specified frequency band with reference to the operation mode management table stored in the storage device 440. In accordance with the specified operation mode, the control unit 410 may generate a control signal with which each switch in the antenna device 430 is turned ON or OFF and may transmit each generated control signal to the antenna device 430.

For example, when the communication device 4 communicates with a base station device in accordance with the LTE in which a 0.7 GHz band is used, the control unit 410 may specify the fourth operation mode corresponding to 0.7 GHz by referring to the operation mode management table. In accordance with the specified fourth operation mode, the control unit 410 may generate control signals, each for turning the first and the third switches OFF and for turning the second switch ON. If the communication device 4 receives a GPS signal, which uses 1.56 to 1.58 GHz bands, the control unit 410 may specify a second operation mode corresponding to 1.56 to 1.58 GHz band by referring to the operation mode management table. In accordance with the specified second operation mode, the control unit 410 may generate control signals, each for turning the first switch ON and for turning the second and the third switches ON.

If the operation mode management table represents correspondency between the identification number of the communication application and the operation mode, the control unit 410 may specify, with reference to the operation mode management table, the operation mode corresponding to the identification number of the communication application to be used. In accordance with the specified operation mode, the control unit 410 may generate control signals for turning each of the switches ON or OFF.

The control unit 410 may output the generated control signals to the antenna device 430. In the antenna device 430, each switch is turned ON or OFF in accordance with the control signals from the control unit 410. The control unit 410 may start communication with other communication devices using a usage frequency band.

In this manner, since the communication device 4, according to the fourth embodiment, performs various communications services in different usage frequency bands, the antenna device 430 may be controlled so that antenna characteristics become desirable corresponding to the frequency band used for the communication.

All examples and conditional language recited herein are intended for pedagogical purposes to aid the reader in understanding as parts of the invention and the concepts contributed by the inventor(s) to furthering the art, and are to be construed as being without limitation to such specifically recited examples and conditions, nor does the organization of such examples in the specification relate to a showing of the superiority and/or inferiority of various aspects of the invention. Although example embodiments of the present invention have been described in detail, it should be understood that the various changes, substitutions, and alterations could be made hereto without departing from the spirit and scope hereof.

What is claimed is:

1. An antenna device, comprising:

a substrate;

a first antenna element disposed on a surface of the substrate, the first antenna element having predetermined antenna characteristics over a certain band, the first antenna element being configured to operate as a wideband antenna and being tilted toward the substrate;

a second antenna element disposed on the surface of the substrate, the second antenna element being configured to have a linear shape, a length of the second antenna element being shorter than twice a length of a side that determines a lowest operating frequency of the first antenna element;

a grounding conductor disposed at a predetermined depth from the surface of the substrate so as not to overlap with the first antenna element and the second antenna element;

a feeder wire disposed on the surface of the substrate, the feeder wire being coupled to a feeding point provided in the first antenna element;

a first switch and a second switch disposed at the feeder wire at predetermined distances from the feeding point;

a first matching element disposed between the feeder wire and the grounding conductor, the first matching element being coupled to the feeder wire in parallel when the first switch is turned to a conductive state;

a second matching element disposed between the feeder wire and the grounding conductor, the second matching element being coupled to the feeder wire in parallel when the second switch is turned to a conductive state; and a third switch configured to switch connecting states of the first antenna element and the second antenna element, wherein the first antenna element includes:

a fan-shaped portion including a curved side and configured to be disposed in contact with the surface of the substrate, a bent portion configured to be in contact with the fan-shaped portion, the bent portion being a portion where the first antenna element is bent substantially vertically upward from the surface of the substrate, and a triangular portion coupled to the bent portion; and wherein the first antenna element is bent so as not to protrude outside the surface of the substrate.

2. The antenna device according to claim 1, wherein the antenna device is configured to operate in any of the following operation modes:

a first operation mode in which the first switch, the second switch, and the third switch are turned OFF;

a second operation mode in which the first switch is turned ON and the second switch and the third switch are turned OFF;

a third operation mode in which the first switch and the second switch are turned OFF and the third switch is turned ON; and a fourth operation mode in which the first switch is turned OFF and the second switch and the third switch are turned ON.

3. The antenna device according to claim 2, wherein a basic resonance frequency of the second operation mode is a frequency between the lowest operating frequency of the first operation mode and the highest operating frequency of the operating frequency band including a basic resonance frequency of the third operation mode; and wherein a basic resonance frequency of the fourth operation mode is lower than the lowest operating frequency of the operating frequency band including the basic resonance frequency of the third operation mode.

4. The antenna device according to claim 1, wherein a distance of the feeder wire from the feeding point to the first switch is shorter than a distance of the feeder wire from the feeding point to the second switch.

5. The antenna device according to claim 1, wherein a distance from a position of the first antenna element furthest from the feeding point to a position at which the second antenna element connects to the first antenna element is shorter than 1/200 of a usage frequency.

6. The antenna device according to claim 1, wherein, when the fan-shaped portion, the bent portion, and the triangular portion are developed to a flat plane, a triangle formed by joining the feeding point and both ends of a side of the triangular portion, which is the furthest from the feeding point, is tilted toward the substrate.

7. The antenna device according to claim 1, wherein the first switch, the second switch, and the third switch comprise any one of a MEMS switch, a PIN diode switch, and a GaAs switch.

8. An antenna device, comprising:

a substrate;

a first antenna element disposed on a surface of the substrate, the first antenna element having predetermined antenna characteristics over a certain band, the first antenna element being configured to operate as a wideband antenna and being tilted toward the substrate;

a second antenna element disposed on the surface of the substrate, the second antenna element being configured to have a linear shape, a length of the second antenna element being shorter than twice a length of a side that determines a lowest operating frequency of the first antenna element;

a grounding conductor disposed at a predetermined depth from the surface of the substrate so as not to overlap with the first antenna element and the second antenna element;

a feeder wire disposed on the surface of the substrate, the feeder wire being coupled to a feeding point provided in the first antenna element;

a first switch and a second switch disposed at the feeder wire at predetermined distances from the feeding point;

a first matching element disposed between the feeder wire and the grounding conductor, the first matching element being coupled to the feeder wire in parallel when the first switch is turned to a conductive state;

a second matching element disposed between the feeder wire and the grounding conductor, the second matching element being coupled to the feeder wire in parallel when the second switch is turned to a conductive state;

a third switch configured to switch connecting states of the first antenna element and the second antenna element;

a first control wire coupled to a driving electrode of the first switch;

a second control wire coupled to a driving electrode of the second switch;

a third control wire coupled to a driving electrode of the third switch; and a grounding wire coupled to a grounding electrode of the third switch, wherein resistance elements are coupled in series to each of the first control wire, the second control wire, the third control wire, and the grounding wire, and wherein the first antenna element includes:

a fan-shaped portion including a curved side and configured to be disposed in contact with the surface of the substrate, a bent portion configured to be in contact with the fan-shaped portion, the bent portion being a portion where the first antenna element is bent substantially vertically upward from the surface of the substrate, and a triangular portion coupled to the bent portion, and wherein the first antenna element is bent so as not to protrude outside the surface of the substrate.

9. A communication device, comprising:

an antenna device including:

a substrate, a first antenna element disposed on a surface of the substrate, the first antenna element having predetermined antenna characteristics over a certain band, being configured to operate as a wideband antenna and tilted, a second antenna element disposed on the surface of the substrate, the second antenna being configured to have a linear shape, a length of the second antenna element being shorter than twice a length of a side that determines the lowest operating frequency of the first antenna element, a grounding conductor disposed at a predetermined depth from the surface of the substrate so as not to overlap with the first antenna element and the second antenna element, a feeder wire disposed on the surface of the substrate, the feeder wire being coupled to a feeding point provided in the first antenna element, a first switch and a second switch disposed at the feeder wire at predetermined distances from the feeding point, a first matching element disposed between the feeder wire and the grounding conductor, the first matching element being coupled to the feeder wire in parallel when the first switch is turned to a conductive state, a second matching element disposed between the feeder wire, the second matching element being coupled to the feeder wire in parallel when the second switch is turned to a conductive state, and a third switch configured to switch a connecting states of the first antenna element and the second antenna element, wherein the first antenna element includes:

a fan-shaped portion including a curved side and configured to be disposed in contact with the surface of the substrate, a bent portion configured to be in contact with the fan-shaped portion, the bent portion being a portion where the first antenna element is bent substantially vertically upward from the surface of the substrate, and a triangular portion coupled to the bent portion, and wherein the first antenna element is bent so as not to protrude outside the surface of the substrate;

a control unit configured to generate a control signal for switching the connecting states of the first switch or the second switch or a connecting state of the third switch in accordance with a usage frequency band, and configured to transmit the generated control signal to the antenna device; and a wireless processing unit configured to receive a signal of a frequency in the usage frequency band from the antenna device and to demodulate the received signal.

10. The communication device according to claim 9, wherein the antenna device is configured to operate in any one of the following operation modes:

a first operation mode in which the first switch, the second switch, and the third switch are turned OFF;

a second operation mode in which the first switch is turned ON and the second switch and the third switch are turned OFF;

a third operation mode in which the first switch and the second switch are turned OFF and the third switch is turned ON; and a fourth operation mode in which the first switch is turned OFF and the second switch and the third switch are turned ON.

11. The communication device according to claim 10, wherein a basic resonance frequency of the second operation mode is a frequency between the lowest operating frequency of the first operation mode and the highest operating frequency of the operating frequency band including a basic resonance frequency of the third operation mode; and wherein a basic resonance frequency of the fourth operation mode is lower than the lowest operating frequency of the operating frequency band including the basic resonance frequency of the third operation mode.

12. The communication device according to claim 9, wherein a distance of the feeder wire from the feeding point to the first switch is shorter than a distance of the feeder wire from the feeding point to the second switch.

13. The communication device according to claim 9, wherein a distance from a position of the first antenna element furthest from the feeding point to a position at which the second antenna element connects to the first antenna element is shorter than 1/200 of a usage frequency.

14. The communication device according to claim 9, wherein, when the fan-shaped portion, the bent portion and the triangular portion are developed to a flat plane, a triangle formed by joining the feeding point and both ends of a side of the triangular portion, which is the furthest from the feeding point, is tilted toward the substrate.

15. The communication device according to claim 9, wherein the first switch, the second switch and the third switch comprise any one of a microelectromechanical systems (MEMS) switch, a PIN diode switch and a GaAs switch.

16. The communication device according to claim 9, wherein the antenna device further includes:

a first control wire coupled to a driving electrode of the first switch;

a second control wire coupled to a driving electrode of the second switch;

a third control wire coupled to a driving electrode of the third switch; and a grounding wire coupled to a grounding electrode of the third switch, wherein resistance elements are coupled in series to each of the first control wire, the second control wire, the third control wire and the grounding wire.

17. The antenna device according to claim 1, wherein the first antenna element is configured to include an electric length at a lowest operating frequency that is substantially equal to ¼ a wavelength.

18. The antenna device according to claim 1, wherein the first antenna element is configured in such a way so as to not to protrude outside the surface of the substrate.

19. The antenna device according to claim 6, wherein the fan-shaped portion, the bent portion, and the triangular portion are aligned to a same flat plane, the first antenna element is configured to include a projecting surface shape with a base being a side of the triangular portion and a vertex being the feeding point.

20. The antenna device of claim 1, wherein the triangular portion is bent substantially vertically toward the substrate at the bent portion.

21. The antenna device of claim 1, wherein a side of the triangular portion which is in contact with the bent portion corresponds to a side of the bent portion in a width direction.

22. The antenna device of claim 1, wherein the triangular portion is parallel with a surface of the fan-shaped portion.

23. The antenna device of claim 1, wherein when the fan-shaped portion, the bent portion, and the triangular portion are aligned to a same flat plane, the first antenna element becomes a projecting-shape with a base being a side of the triangular portion and a vertex being the feed point.

24. The antenna device of claim 1, wherein a length along an outer edge of the first antenna element from one end of a side of the triangular portion determines a lowest operating frequency of the first antenna element.

* * * * *